US006820702B2

(12) United States Patent
Niedermayr et al.

(10) Patent No.: US 6,820,702 B2
(45) Date of Patent: Nov. 23, 2004

(54) AUTOMATED METHOD AND SYSTEM FOR RECOGNIZING WELL CONTROL EVENTS

(75) Inventors: Michael Niedermayr, Stafford, TX (US); Mitchell D. Pinckard, Houston, TX (US); Gerhard P. Glaser, Houston, TX (US); Joao Tadeu Vidal de Sousa, Norman, OK (US)

(73) Assignee: Noble Drilling Services Inc., Sugar Land, TX (US)

( * ) Notice: Subject to any disclaimer, the term of this patent is extended or adjusted under 35 U.S.C. 154(b) by 7 days.

(21) Appl. No.: 10/229,470

(22) Filed: Aug. 27, 2002

(65) Prior Publication Data

US 2004/0040746 A1 Mar. 4, 2004

(51) Int. Cl.[7] ..... E21B 44/06; E21B 21/08

(52) U.S. Cl. ..... 175/57; 175/38; 175/48; 175/24; 73/152.21; 73/152.29

(58) Field of Search ..... 175/26, 27, 38, 175/7, 40, 48, 50, 24, 72, 57; 73/152.19, 152.21, 152.29, 152.31

(56) References Cited

U.S. PATENT DOCUMENTS

| | | | | |
|---|---|---|---|---|
| 3,115,576 A | | 12/1963 | Rickard | 250/43.5 |
| 3,602,322 A | | 8/1971 | Gorsuch | 175/48 |
| 4,250,974 A | | 2/1981 | Heilhecker et al. | 175/48 |
| 4,282,939 A | | 8/1981 | Maus et al. | 175/7 |
| 4,354,233 A | | 10/1982 | Zhukovsky et al. | 364/420 |
| 4,507,735 A | | 3/1985 | Moorehead et al. | 364/422 |
| 4,553,429 A | | 11/1985 | Evans et al. | 73/155 |
| 4,610,161 A | * | 9/1986 | Gehrig et al. | 73/152.21 |
| 4,649,388 A | | 3/1987 | Atlas | 342/26 |
| 4,703,664 A | | 11/1987 | Kirkpatrick et al. | 73/866.5 |
| 4,802,143 A | | 1/1989 | Smith | 367/82 |
| 4,825,962 A | | 5/1989 | Girault | 175/26 |
| 4,875,530 A | | 10/1989 | Frink et al. | 175/27 |
| 4,876,886 A | | 10/1989 | Bible et al. | 73/151.1 |
| 5,063,776 A | * | 11/1991 | Zanker et al. | 73/152.21 |
| 5,154,078 A | * | 10/1992 | Codazzi | 73/152.22 |
| 5,222,048 A | | 6/1993 | Grosso et al. | 367/32 |
| 5,303,328 A | | 4/1994 | Masui et al. | 395/23 |
| 5,413,750 A | | 5/1995 | Kelman et al. | 264/517 |
| 5,454,436 A | | 10/1995 | Jardine et al. | 175/40 |
| 5,465,321 A | | 11/1995 | Smyth | 395/22 |
| 5,469,369 A | | 11/1995 | Rose-Pehrsson et al. | 364/497 |
| 5,474,142 A | | 12/1995 | Bowden | 175/27 |
| 5,539,704 A | | 7/1996 | Doyen et al. | 367/73 |
| 5,659,135 A | | 8/1997 | Cacas | 73/152.02 |
| 5,699,246 A | | 12/1997 | Plasek et al. | 364/422 |
| 5,730,234 A | | 3/1998 | Putot | 175/50 |

(List continued on next page.)

FOREIGN PATENT DOCUMENTS

| | | | |
|---|---|---|---|
| EP | 0 437 872 A2 | 7/1991 | G01F/1/100 |
| WO | WO 02/50398 A1 | 6/2002 | E21B/21/08 |

OTHER PUBLICATIONS

J. M. Speers et al., "Delta Flow: An Accurate, Reliable System for Detecting Kicks and Loss of Circulation During Drilling," *SPE Drilling Engineering*, Dec. 1987, 5 pages.

S. I. Jardine et al., "An Improved Kick Detection System for Floating Rigs," SPE 23133, *Society of Petroleum Engineers, Inc.*, 1991, 8 pages.

(List continued on next page.)

*Primary Examiner*—David Bagnell
*Assistant Examiner*—T. Shane Bomar
(74) *Attorney, Agent, or Firm*—Baker Botts L.L.P.

(57) ABSTRACT

An automated method and system for recognizing a well control event includes determining a state of drilling operations. When drilling operations are in a circulating state, a benchmark for a relative flow value. The relative flow value is based on a flow of drilling fluid into a well bore and a flow of drilling fluid out of the well bore. A limit on variation of the relative flow value is determined from the benchmark. A cumulative sum for the relative flow value is determined over time in response to the relative flow value exceeding the limit. A well control event is recognized based on the cumulative sum.

66 Claims, 11 Drawing Sheets

U.S. PATENT DOCUMENTS

| | | | | |
|---|---|---|---|---|
| 5,952,569 | A | 9/1999 | Jervis et al. | 73/152.01 |
| 5,978,739 | A | 11/1999 | Stockton | 702/6 |
| 6,026,912 | A | 2/2000 | King et al. | 175/27 |
| 6,152,246 | A | 11/2000 | King et al. | 175/26 |
| 6,155,357 | A | 12/2000 | King et al. | 175/27 |
| 6,192,980 | B1 | 2/2001 | Tubel et al. | 166/65.1 |
| 6,192,998 | B1 | 2/2001 | Pinckard | 175/27 |
| 6,233,524 | B1 | 5/2001 | Harrell et al. | 702/9 |
| 6,250,395 | B1 | 6/2001 | Torres | 166/382 |
| 6,253,860 | B1 | 7/2001 | Pöysti et al. | 173/1 |
| 6,257,354 | B1 * | 7/2001 | Schrader et al. | 175/38 |
| 6,293,356 | B1 | 9/2001 | King et al. | 175/27 |
| 6,371,204 | B1 * | 4/2002 | Singh et al. | 166/250.03 |
| 6,382,331 | B1 * | 5/2002 | Pinckard | 175/27 |
| 6,443,242 | B1 * | 9/2002 | Newman et al. | 175/57 |
| 6,474,422 | B2 * | 11/2002 | Schubert et al. | 175/69 |
| 6,484,816 | B1 * | 11/2002 | Koederitz | 175/25 |
| 6,574,565 | B1 | 6/2003 | Bush | 702/14 |
| 2002/0120401 | A1 | 8/2002 | Macdonald et al. | 702/6 |

OTHER PUBLICATIONS

Weishaupt et al., "Rig computer System Improves Safety for Deep HP/HT Wells by Kick Detection and Well Control Monitoring," SPE 23053, *Society of Petroleum Engineers, Inc.*, 1991, 8 pages.

Harmse et al., "Intelligent Drilling Monitor Detects Downhole Problems," *GasTIPS*, Feb. 2000, 7 pages.

G. P. Corser et al., "Filed Test Results for a Real–Time Intelligent Drilling Monitor," IADC/SPE 59227, *International Association of Drilling Contractors* and *Society of Petroleum Engineers*, Feb. 2000, 12 pages.

Hargreaves et al., "Early Kick Detection for Deepwater Drilling: New Probabilistic Methods Applied in the Field," SPE 71369, *Society of Petroleum Engineers Inc.*, 2001, 11 pages.

G. Martin Milner et al., "Data Processing and Interpretation While Drilling," AADE 01–CH–HO–38, *American Association of Drilling Engineers*, 2001, 14 pages.

"WW Advanced Kick Detection Package" information brochure, *Datalog*, 2001, 4 pages.

"Well Stability Analyzer™" Brochure, *National Oilwell*, date unknown, 1 page.

U.S. patent application Ser. No. 10/153,845, entitled "Automated Method and System for Determining the State of Well Operations and Performing Process Evaluation," filed May 21, 2002, 72 total pages.

C.P. Leach, et al., "Use of a Kick Stimulator as a Well Planning Tool," *Society of Petroleum Engineers*, 1992, 9 pages.

D. Dashevskiy, et al., "Application of Neural Networks for Predicitive Control in Drilling Dynamics," *Society of Petroleum Engineers*, 1999, 8 pages.

A.J. Mansure, et al., "A Probabilistic Reasoning Tool for Circulation Monitoring Based on Flow Measurements," *Society of Petroleum Engineers, Inc.*, 1999, 13 pages.

G.M. Milner, "Real–Time Well Control Advisor", *Society of Petroleum Engineers, Inc.*, 1992, 9 pages.

B.W. Swanson, et al. "Slimhole Early Kick Detection by Real–Time Drilling Analysis," *Society of Petroleum Engineers*, 1983, 11 pages.

G.M. Lloyd, et al., "Practical Application of Real–Time Expert System for Automatic Well Control," *Society of Petroleum Engineers, Inc., International Association of Drilling Contractors*, 1990, 12 pages.

Bode, D.J., SPE, et al., "*Well–Control Methods and Practices in Small–Diameter Wellbores*", JPT, Nov. 1991, pp. 1380–1386, with 4 pages of additional figures.

Hutchinson, et al., "*An MWD Downhole Assistant Driller*", Society of Petroleum Engineers, SPE #30523, vol. 30523, pp. 743–752, XP000618424, Oct. 22, 1995.

PCT International Search Report for PCT US03/26373, 7 pages, Jan. 2, 2004.

* cited by examiner

FROM FIG. 5A
158
BIT POSITION INCREASING ?
YES
NO
162
HOOK LOAD = BIT WEIGHT?
YES
NO
SLIP AND CUT LINE
192
168
RPM ≥1
YES
NO
170
RPM ≥1
NO
YES
180
SPP ≥20
YES
NO
182
SPP ≥20
YES
NO
184
SPP ≥20
YES
NO
186
SPP ≥20
YES
NO
REAM WHILE TIH
212
214
WORKING PIPE WHILE TIH
WASHING WHILE TIH
216
218
TRIPPING IN HOLE (TIH)
BACK REAMING
220
222
WORKING PIPE TOH
WASHING WHILE TOH
224
226
TRIPPING OUT OF HOLE (TOH)

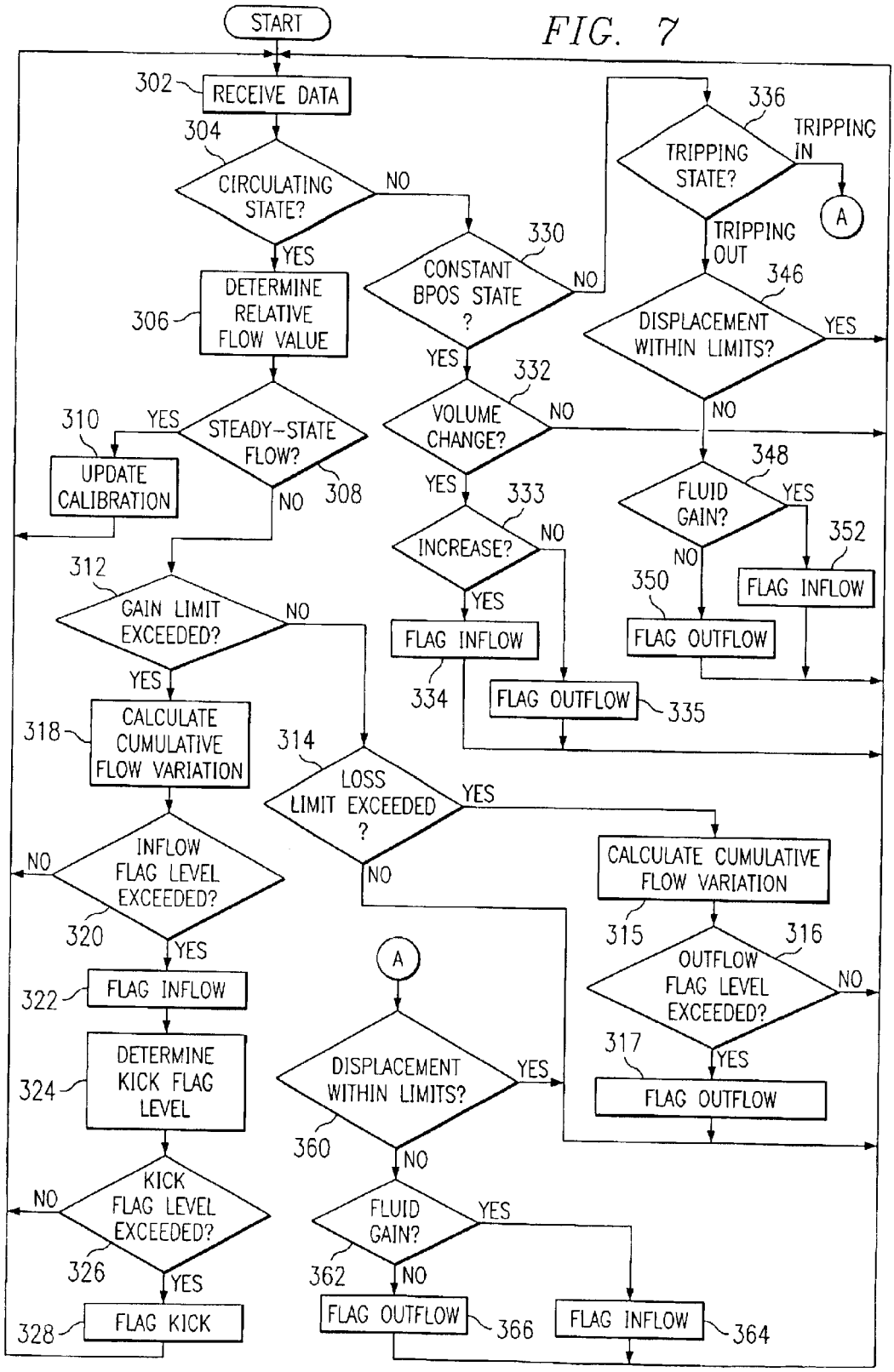
FIG. 7
START
302
RECEIVE DATA
304
CIRCULATING STATE?
NO
YES
306
DETERMINE RELATIVE FLOW VALUE
310
YES
STEADY-STATE FLOW?
308
UPDATE CALIBRATION
NO
312
GAIN LIMIT EXCEEDED?
NO
YES
318
CALCULATE CUMULATIVE FLOW VARIATION
INFLOW FLAG LEVEL EXCEEDED?
NO
320
YES
322
FLAG INFLOW
324
DETERMINE KICK FLAG LEVEL
KICK FLAG LEVEL EXCEEDED?
NO
326
YES
328
FLAG KICK
330
CONSTANT BPOS STATE ?
NO
YES
332
VOLUME CHANGE?
NO
YES
333
INCREASE?
NO
YES
FLAG INFLOW
334
FLAG OUTFLOW
335
314
LOSS LIMIT EXCEEDED ?
YES
NO
A
DISPLACEMENT WITHIN LIMITS?
YES
360
NO
FLUID GAIN?
YES
362
NO
FLAG OUTFLOW
366
FLAG INFLOW
364
336
TRIPPING STATE?
TRIPPING IN
A
TRIPPING OUT
346
DISPLACEMENT WITHIN LIMITS?
YES
NO
348
FLUID GAIN?
YES
NO
352
FLAG INFLOW
350
FLAG OUTFLOW
CALCULATE CUMULATIVE FLOW VARIATION
315
316
OUTFLOW FLAG LEVEL EXCEEDED?
NO
YES
317
FLAG OUTFLOW

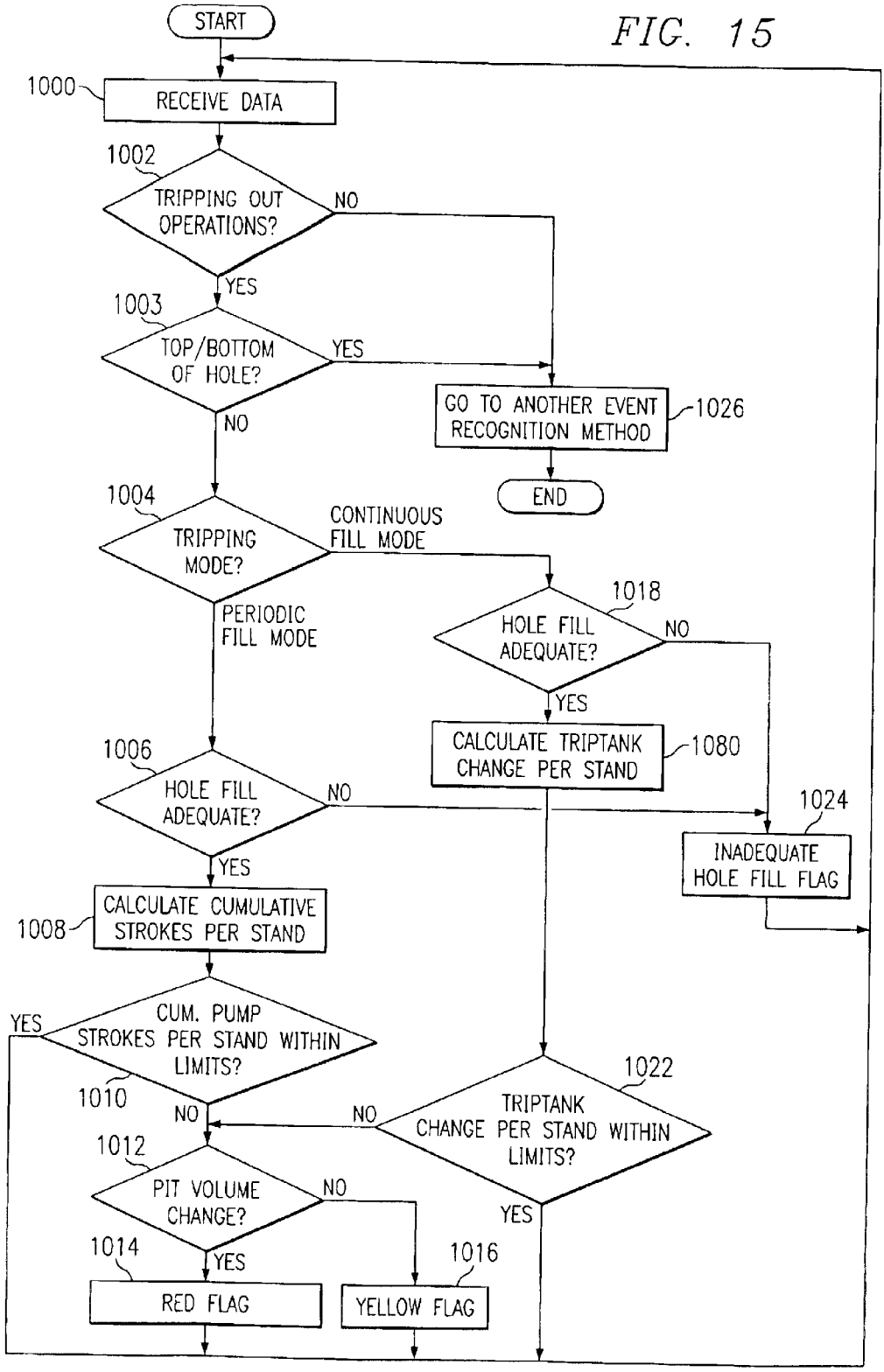
FIG. 15
START
1000
RECEIVE DATA
1002
TRIPPING OUT OPERATIONS?
NO
YES
1003
TOP/BOTTOM OF HOLE?
YES
NO
GO TO ANOTHER EVENT RECOGNITION METHOD
1026
END
1004
TRIPPING MODE?
CONTINUOUS FILL MODE
PERIODIC FILL MODE
1018
HOLE FILL ADEQUATE?
NO
YES
CALCULATE TRIPTANK CHANGE PER STAND
1080
1006
HOLE FILL ADEQUATE?
NO
YES
1024
INADEQUATE HOLE FILL FLAG
CALCULATE CUMULATIVE STROKES PER STAND
1008
YES
CUM. PUMP STROKES PER STAND WITHIN LIMITS?
1010
NO
NO
1022
TRIPTANK CHANGE PER STAND WITHIN LIMITS?
YES
1012
PIT VOLUME CHANGE?
NO
YES
1014
RED FLAG
1016
YELLOW FLAG

AUTOMATED METHOD AND SYSTEM FOR RECOGNIZING WELL CONTROL EVENTS

TECHNICAL FIELD OF THE INVENTION

This invention relates generally to the field of drilling rig management systems, and more particularly to an automated method and system for recognizing well control events.

BACKGROUND OF THE INVENTION

Drilling rigs are typically rotary-type rigs that use a sharp bit to drill through the earth. At the surface, a rotary drilling rig includes a complex system of cables, engines, support mechanisms, tanks, lubricating devices, and pulleys to control the position and rotation of the bit below the surface.

Underneath the surface, the bit is attached to a long drill pipe that carries drilling fluid to the bit. The drilling fluid lubricates and cools the bit, as well as removes cuttings and debris from the well bore. In addition, the drilling fluid provides a hydrostatic head of pressure that prevents the collapse of the well bore until it can be cased and that prevents formation fluids from entering the well bore, which can lead to gas kicks and other dangerous situations.

Automated management of drilling rig operations is problematic because parameters may change quickly and because down hole behavior of drilling elements and down hole conditions may not be directly observable. As a result, many management systems fail to accurately recognize the presence and/or absence of important drilling events, which may lead to false alarms and unnecessary down time.

SUMMARY OF THE INVENTION

The present invention provides an automated method and system for recognizing well control events that substantially reduce or eliminate the disadvantages and problems associated with previous systems and methods. In a particular embodiment, the flow of fluids into or out of a formation during well operations is determined based on sensed data and the state of well operations. Accordingly, influx or outflux of fluids in a well may be accurately recognized during drilling, tripping and other suitable well operations.

An automated method and system for recognizing a well control event includes determining a state of drilling operations. When drilling operations are in a circulating state, a benchmark for a relative flow value is determined. The relative flow value may be based on a flow of drilling fluid into a well bore and a flow of drilling fluid out of the well bore. A limit on variation of the relative flow value is determined from the benchmark. A cumulative sum for the relative flow value is determined over time in response to the relative flow value exceeding the limit. A well control event is recognized based on the cumulative sum.

In a particular embodiment, the present invention accurately recognizes inflow and outflow well control events based on drilling system parameters and dynamically determined limits. Inflow and outflow events may be recognized during drilling and/or circulation states of drilling operation as well as during non-circulation states such as constant bit position, tripping-out and tripping-in. In addition, for drilling ships, semi-submersibles, and other buoyant drilling vessels and structures, heave may be determined and compensated for in recognizing events.

Technical advantages of the present invention include providing an automated method and system for recognizing well control events. In a particular embodiment, well events are recognized based on the state of well operations. As a result, well events may be accurately recognized during drilling, tripping and other suitable well operations. In addition, the state determination engine provides a modular architecture to event recognition. Accordingly, a control system for a well may be readily adapted to recognize events during different stages of the well.

Still another technical advantage of the present invention includes providing an improved drilling rig. In particular, sensed and/or reported data is utilized to enhance accuracy and to allow for earlier, more effective and more efficient recognition of potentially hazardous events such as well control events, stuck pipe, and pack off. This may result in the more effective taking of corrective operations and a reduction in the frequency and severity of undesirable events.

Still another technical advantage of the present invention includes providing heave compensation for buoyant drilling vessels and structures. In particular embodiments, circulation rates into and out of the well bore as well as mud tank volumes used in determining events may be adjusted for changes caused by heave or other displacement of the drilling platform.

It will be understood that the various embodiments of the present invention may include some, all, or none of the enumerated technical advantages. In addition, other technical advantages of the present invention may be readily apparent from the following figures, description and claims.

BRIEF DESCRIPTION OF THE DRAWINGS

For a more complete understanding of the present invention and its advantages, reference is now made to the following description, taken in conjunction with the accompanying drawings, in which:

FIG. 7 is a flow diagram illustrating a method for event recognition in accordance with one embodiment of the present invention;

FIG. 15 is a flow diagram illustrating a method of well control event recognition during tripping-out-of the-hole operations in accordance with one embodiment of the present invention.

DETAILED DESCRIPTION OF THE INVENTION

The present invention provides an automated method and system for recognizing well control events. In one embodiment, as described with particularity below, the present invention may be used to automatically determine well control events during drilling operations. In other embodiments, as also described below, the present invention may be used to determine well control events during well intervention and other post-drilling operations. In each of these embodiments, well control events may be recognized based on the state of well operations.

Figure 1:
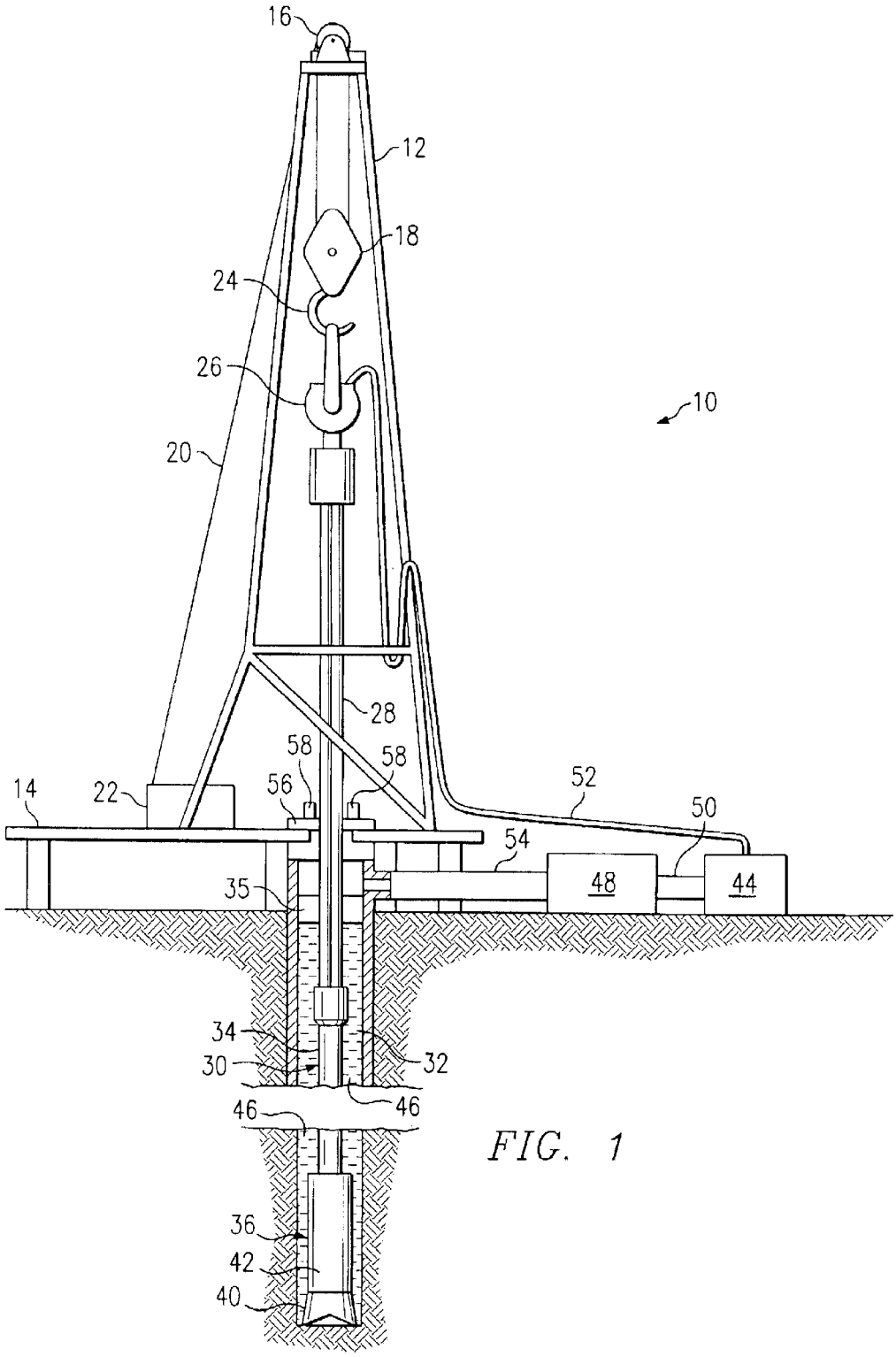
FIG. 1 is a schematic diagram of a drilling rig in accordance with one embodiment of the present invention.

FIG. 1 illustrates a drilling rig 10 in accordance with one embodiment of the present invention. In this embodiment, the rig 10 is a conventional rotary land rig. However, the present invention is applicable to other suitable drilling technologies and/or units, including top drive, power swivel, down hole motor, coiled tubing units, and the like, and to non-land rigs, such as jack up rigs, semisubmersables, drill ships, mobile offshore drilling units (MODUs), and the like that are operable to bore through the earth to resource-bearing or other geologic formations.

The rig 10 includes a mast 12 that is supported above a rig floor 14. A lifting gear includes a crown block 16 mounted to the mast 12 and a travelling block 18. The crown block 16 and the travelling block 18 are interconnected by a cable 20 that is driven by draw works 22 to control the upward and downward movement of the travelling block 18.

The travelling block 18 carries a hook 24 from which is suspended a swivel 26. The swivel 26 supports a kelley 28, which in turn supports a drill string, designated generally by the numeral 30 in the well bore 32. A blow out preventor (BOP) 35 is positioned at the top of the well bore 32. The string may be held by slips 58 during connections and rig-idle situations or at other appropriate times.

The drill string 30 includes a plurality of interconnected sections of drill pipe or coiled tubing 34 and a bottom hole assembly (BHA) 36. The BHA 36 includes a rotary drilling bit 40 and a down hole, or mud, motor 42. The BHA 36 may also include stabilizers, drill collars, measurement well drilling (MWD) instruments, and the like.

Mud pumps 44 draw drilling fluid, or mud, 46 from mud tanks 48 through suction line 50. A "mud tank" may include any tank, pit, vessel, or structure which mud can be pumped out of, stored, returned to, and/or recirculated. "Mud" may include any drilling fluids or gases or mixture thereof. The drilling fluid 46 is delivered to the drill string 30 through a mud hose 52 connecting the mud pumps 44 to the swivel 26. From the swivel 26, the drilling fluid 46 travels through the drill string 30 to the BHA 36, where it turns the down hole motor 42 and exits the bit 40 to scour the formation and lift the resultant cuttings through the annulus to the surface. At the surface, mud tanks 48 receive the drilling fluid from the well bore 32 through a flow line 54. The mud tanks 48 and/or flow line 54 include a shaker or other device to remove the cuttings.

The mud tanks 48 and mud pumps 44 may include trip tanks and pumps for maintaining drilling fluid levels in the well bore 32 during tripping out of hole operations and for receiving displaced drilling fluid from the well bore 32 during tripping-in-hole operations. In a particular embodiment, the trip tank is connected between the well bore 32 and the shakers. A valve is operable to divert fluid away from the shakers and into the trip tank, which is equipped with a level sensor. Fluid from the trip tank can then be directly pumped back to the well bore via a dedicated centrifugal pump instead of through the standpipe.

Drilling is accomplished by applying weight to the bit 40 and rotating the drill string 30, which in turn rotates the bit 40. The drill string 30 is rotated within bore hole 32 by the action of a rotary table 56 rotatably supported on the rig floor 14. Alternatively or in addition, the down hole motor may rotate the bit 40 independently of the drill string 30 and the rotary table 56. As previously described, the cuttings produced as bit 40 drills into the earth are carried out of bore hole 32 by the drilling fluid 46 supplied by pumps 44.

Figure 2:
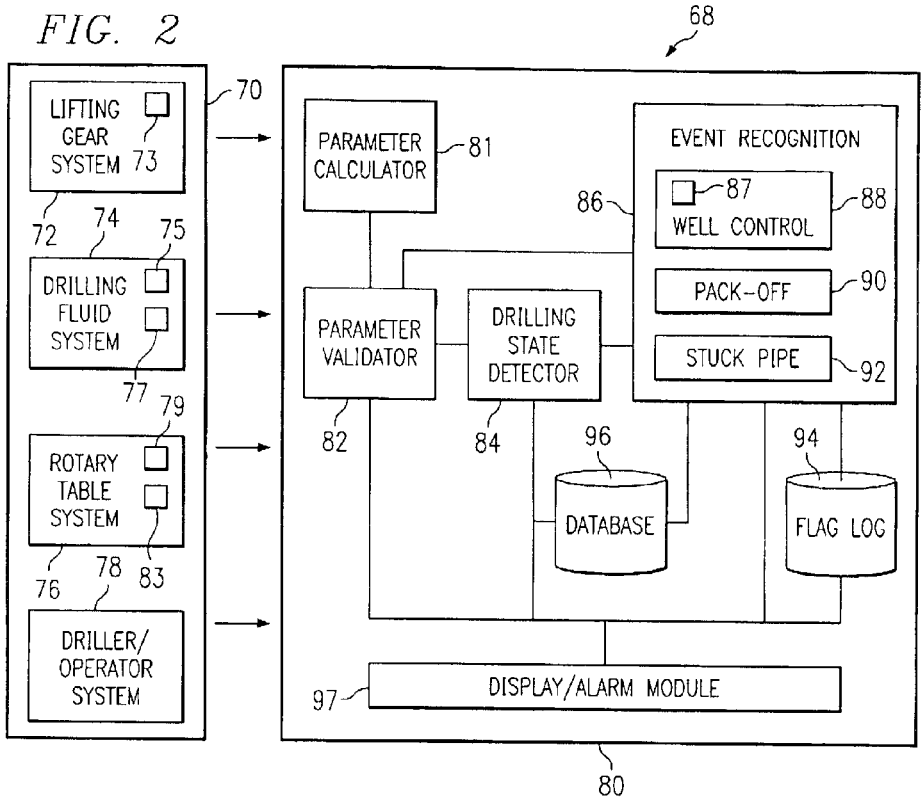
FIG. 2 is a block diagram of a monitoring system for a drilling operation in accordance with one embodiment of the present invention.

FIG. 2 illustrates a well monitoring system 68 in accordance with one embodiment of the present invention. In this embodiment, the monitoring system is a drilling monitoring system 68 for the rig 10. The monitoring system 68 comprises a sensing system 70 and a monitoring module 80 for drilling operations of the rig 10. Well monitoring systems for other well operations may comprise a sensing system with sensors similar, analogous or different to those of sensing system 70 for use in connection with a monitoring module, which may be similar, analogous or different than module 80. As described in more detail below, drilling operations may comprise drilling, tripping, testing, reaming, conditioning, and other and/or different operations, or states, of the drilling system. A state may be any suitable operation or activity or set of operations or activities of which all, some or most are based on a plurality of sensed parameters.

The sensing system 70 includes a plurality of sensors that monitor, sense, and/or report data, or parameters, on the rig 10, and/or in the bore hole 32. The reported data may comprise the sensed data or may be derived, calculated or inferred from sensed data.

In the illustrated embodiment, the sensing system 70 comprises a lifting gear system 72 that reports data sensed by and/or for the lifting gear; a fluid system 74 that reports data sensed by and/or for the drilling fluid tanks, pumps, and lines; rotary system 76 that reports data sensed by and/or for the rotary table or other rotary device; and an operator system 78 that reports data input by a driller/operator. As previously described, the sensed data may be refined, manipulated or otherwise processed before being reported to the monitoring module 80. It will be understood that sensors may be otherwise classified and/or grouped in the sensor system 70 and that data may be received from other additional or different systems, subsystems, and items of equipment. The systems that perform a well operation, which in some contexts may be referred to as subsystems, may each comprise related processes that together perform a distinguishable, independent, independently controllable and/or separable function of the well operation and that may interact with other systems in performing their function of the operation.

The lifting gear system 72 includes a hook weight sensor 73, which may comprise digital strain gauges or other sensors that report a digital weight value once a second, or at another suitable sensor sampling rate. The hook weight sensor may be mounted to the static line (not shown) of the cable 20.

The fluid system 74 includes a stand pipe pressure sensor 75 which reports a digital value at a sampling rate of the pressure in the stand pipe. The drilling fluid system may also include a mud pump sensor 77 that measures mud pump speed in strokes per minute, from which the flow rate of drilling fluids into the drill string can be calculated. Additional and/or alternative sensors may be included in the drilling fluid system 74 including, for example, sensors for measuring the volume of fluid in mud tank 46 and the rate of flow into and out of mud tank 46. Also, sensors may be included for measuring mud gas, flow line temperature, and mud density.

The rotary system 76 includes a rotary table revolutions per minute (RPM) sensor 79 which reports a digital value at a sampling rate. The RPM sensor may also report the direction of rotation. A rotary torque sensor 83 may also be included which measures the amount of torque applied to drill string 34 during rotation. The torque may be indicated by measuring the amount of current drawn by the motor that draws rotary table 46. The rotary torque sensor may alternatively sense the tension in the rotary table drive chain.

The operator system 78 comprises a user interface or other input system that receives input from a human operator/driller who may monitor and report observations made during the course of drilling. For example, bit position (BPOS) may be reported based upon the length of the drill string 30 that has gone down hole, which in turn is based upon the number of drill string segments the driller has added to the string during the course of drilling. The driller/operator may keep a tally book of the number of segments added, and/or may input this information in a Supervisory Control and Data Acquisition (SCADA) reporting system.

Other parameters may be reported or calculated from reported values. For example, other suitable hydraulic and/or mechanical data may be reported. Hydraulic data is data related to the flow, volume, movement, rheology, and other aspects of drilling or other fluid performing work or otherwise used in operations. The fluids may be liquid, gaseous or otherwise. Mechanical data is data related to support or physical action upon or of the drill string, bit or any other suitable device associated with the drilling or other operation. Mechanical and hydraulic data may originate with any suitable device operable to accept, report, determine, estimate a value, status, position, movement, or other parameter associated with a well operation. As previously described, mechanical and hydraulic data may originate from machinery sensor data such as motor states and RPMs and for electric data such as electric power consumption of top drive, mud transfer pumps or other satellite equipment. For example, mechanical and/or hydraulic data may originate from dedicated engine sensors, centrifugal on/off sensors, valve position switches, fingerboard open/close indicators, SCR readings, video recognition and any other suitable sensor operable to indicate and/or report information about a device or operation of a system. In addition, sensors for measuring well bore trajectory, and/or petrophysical properties of the geologic formations, as well down hole operating parameters, may be sensed and reported. Down hole sensors may communicate data by wireline, mud pulses, acoustic wave, and the like. Thus, the data may be received from a large number of sources and types of instruments, instrument packages and manufacturers and may be in many different formats. The data may be used as initially reported or may be reformatted and/or converted. In a particular embodiment, data may be received from two, three, five, ten, twenty, fifty, a hundred or more sensors and from two, three, five, ten or more systems. That data and/or information determined from the data may be a value or other indication of the rate, level, rate of change, acceleration, position, change in position, chemical makeup, or other measurable information of any variable of a well operation.

The monitoring module 80 receives and processes data from the sensing system 70 or from other suitable sources and monitors the drilling system and conditions based on the received data. As previously described, the data may be from any suitable source, or combinations of sources and may be received in any suitable format. In one embodiment, the monitoring system 80 comprises a parameter calculator 81, a parameter validator 82, a drilling state determination detector 84, an event recognition module 86, a database 96, a flag log 94, and a display/alarm module 97. It will be understood that the monitoring system 80 may include other or different programs, modules, functions, database tables and entries, data, routines, data storage, and other suitable elements, and that the various components may be otherwise integrated or distributed between physically disparate components. In a particular embodiment, the monitoring module 80 and its various components and modules may comprise logic encoded in media. The logic may comprise software stored on a computer-readable medium for use in connection with a general purpose processor, or programmed hardware such as application-specific integrated circuits (ASIC), field programmable gate arrays (FPGA), digital signal processors (DSP) and the like.

The parameter calculator 81 derives/infers or otherwise calculates state indicators for drilling operations based on reported data for use by the remainder of monitoring system 80. Alternatively, the calculations could be conducted by processes or units within the sensing systems themselves, by an intermediary system, the drilling state detector 84, or by the individual module of the monitoring system 80. A state indicator is a value or other parameter based on sensed data and is indicative of the state of drilling operations. In one embodiment, the state indicators comprise measured depth (MD), hook load (HKLD), bit position (BPOS), stand pipe pressure (SPP), and rotary table revolutions per minute (RPM).

The state indicators, either directly reported or calculated via calculator 81 and other parameters, may be received by the parameter validator 82. The parameter validator 82 recognizes and eliminates corrupted data and flags malfunctioning sensor devices. In one embodiment, the parameter validation compares each parameter to a status and/or dynamic allowable range for the parameter. The parameter is flagged as invalid if outside the acceptable range. As used herein, each means every one of at least a subset of the identified items. Reports of corrupted data or malfunctioning sensor devices can be sent to and stored in flag log 94 for analysis, debugging, and record keeping.

The validator 82 may also smooth or statistically filter incoming data. Validated and filtered parameters may be directly utilized for event recognition, or may be utilized to determine the state drilling operations of the rig 10 via the drilling state determination detector 84.

The drilling state determination detector 84 uses combinations of state indicators to determine the current state of drilling operations. The state may be determined continuously at a suitable update rate and in real time. "Real time" means of or related to a time frame imposed by external constraints. Real time acts and/or operations may be operations in which a machine's activities match human perception of time, those in which computer operations proceed at the same rate as physical or external processes, and/or those when the system responds to situations as they occur. A drilling state is an overall conclusion regarding the status of the well operation at a given point in time based on the operation of and/or parameters associated with one or more key drilling elements of the rig. Such elements may include the bit, string, and drilling fluid.

In one embodiment, the drilling state determinator module 84 stores a plurality of possible and/or predefined states for drilling operations for the rig 10. The states may be stored by storing a listing of the states, storing logic differentiating the states, storing logic operable to determine disparate states, predefining disparate states or by otherwise suitably maintaining, providing or otherwise storing information from which disparate states of an operation can be determined. In this embodiment, the state of drilling operations may be selected from the defined set of states based on the state indicators. For example, if the bit is substantially off bottom, there is no substantial rotation of the string, and drilling fluid is substantially circulating, then based on this set of state indicators, drilling state detector 84 determines the state of drilling operations to be and/or described as circulating off bottom. On the other hand, if the drill bit is moving into the hole and the string is rotating, but there is no circulation of drilling fluid, the state of drilling operations can be determined to be and/or described as working pipe. Examples and explanations of these and other drilling states and their determination by the drilling state determination module 84 may be found in reference to FIGS. 4 and 5. The states may be stored locally and/or remotely, may be titled or untitled, may be represented by any suitable type of signal and may be determined mathematically, by comparisons, by logic trees, by lookups, by expert systems such as an inferencing engine and in any other suitable manner. The states may be sections or parts of a continuous spectrum. Thus, for example, the state may be determined by selection of a predefined state based on matching criteria and/or one or more comparisons. The state may be determined repetitively, continuously, substantially continuously or otherwise. A process is substantially continuous when it is continuous for a majority of processes for a well operation and/or cycles on a periodic basis on the order of magnitude of a second, or less. Repetitively determined processes may be determined continuously or periodically, and may be determined automatically or in response to a condition or input.

The event recognition module 86 receives drilling parameters and/or drilling state conclusions and recognizes or flags events, or conditions. Such conditions may be alert conditions such as hazardous, troublesome, problematic or noteworthy conditions that affect the safety, efficiency, timing, cost or other aspect of a well operation. For drilling operations, drilling events comprise potentially significant, hazardous, or dangerous happenings or other situations encountered while drilling that may be important to flag or bring to the attention of a drilling supervisor. Events may include stuck pipe, pack off, or well control events such as kicks.

The event recognition module 86 may comprise sub-modules operable to recognize different kinds of events. For example, well control events such as formation fluid (including gases) influxes into the well bore or mud losses from the well bore into formations may be recognized via operation of well control sub-module 88. A well control event is any suitable event associated with a well that can be controlled by application or adjustment of a well fluid, flow, volume, or device such as circulation of fluid during drilling operations. Pack-off events, such as, for example, when drill cuttings clog the annulus, may be recognized via operation of pack-off sub-module 90, and stuck pipe events may be recognized via operation of stuck pipe sub-module 92. Other events may be useful to recognize and flag, and the event recognition module 86 may be configured with other modules with which this is accomplished. Control evaluation and/or decisions may be performed continuously, repetitively and/or substantially continuously as previously described. In another embodiment, the state and event recognition may be performed in response to one or more predefined events or flags that arise during the well operation.

A fuzzy logic processor 87 may be included in well control sub-module 88, accessed by well control sub-module 88 or otherwise used in conjunction with sub-module 88. The fuzzy logic module may comprise a Fuzzy-Logic Toolbox for MATLAB distributed by Mathworks or other suitable fuzzy logic processor. The fuzzy logic processor may be operable to receive data from the lifting gear system 72, the drilling fluid system 74, the rotary system table system 76, the driller/operator system 78, the drilling state determination detector 84, and/or other sources and may be used to determine or adjust flag levels for well control event recognition. Specifically, in a particular embodiment, the fuzzy logic processor 87 may be configured to accept inputs including standpipe pressure, pump strokes per minute, weight on bit, pit volume, comparative flow values, and other data, in addition to drilling state information from the drilling state determination detector 84, in determining an appropriate kick flag warning level for a particular set of drilling parameters and conditions. Further details regarding inputs, operation, and output of the fuzzy logic processor 87 and other aspects of well control event recognition are described in reference to FIGS. 7–14. A neural network, artificial intelligence module, or other suitable processor may be used with and/or in place of the fuzzy logic controller to provide real-time and dynamic alarms and/or conditions. In addition, the fuzzy logic processor 87 may be used by the pack-off sub-module 90, the stuck pipe sub-module 92, and/or other functions of event recognition.

Drilling parameters, drilling states, event recognitions, and alert flags may be displayed to the user on display/alarm module 97, stored in database 96, and/or made accessible to other modules within monitoring system 80 or to other systems or users as appropriate. Database 96 may be configured to record trends in data over time. From these data trends it may be possible, for example, to infer and flag long-term effects such as bore-hole degradation caused by repeated tripping within the bore hole.

In operation, the monitoring system 80 may allow for an increase in quality control with respect to sensing devices and the monitoring of the timing and efficiency of drilling operations. Events such as kicks may be accurately detected and flagged while drilling earlier than is possible via human observation of rig operations, thus resulting in the more effective taking of corrective operations and a reduction in the frequency and severity of undesirable events. In addition, the provisioning of state information may allow false alarms to be minimized, more accurate event recognition and residual down time. Another potential benefit may be an increased ability to automate daily and end-of-well reporting procedures.

The states may be determined, control evaluation provided, and/or events recognized without manual or other input from an operator or without direct operator input. Operator input may be direct when the input forms a state indicator used directly by the state engine. In addition, the state, evaluation and recognition processes may be performed without substantial operator input. For example, processes may run independently of operator input but may utilize operator overrides of erroneous readings or other analogous inputs during instrument or other failure conditions. It will be understood that a process may run independently of operator input during operation and/or normal operation and still be manually, directly, or indirectly started, initiated, interrupted or stopped. With or without operator input, the state recognition processes are substantially based on instrument sensed parameters that are monitored in real-time and dynamically changing.

Figure 3:
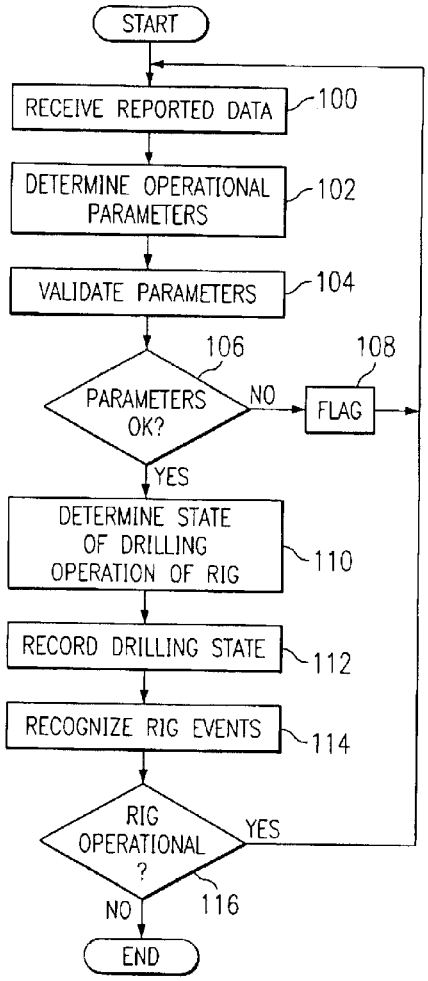
FIG. 3 is a flow diagram illustrating a method for monitoring a drilling operation in accordance with one embodiment of the present invention.

FIG. 3 illustrates a method for monitoring a rig in accordance with one embodiment of the present invention. In this embodiment, the state of drilling operation is determined and drilling events are recognized based on operational data and the drilling state. It will be understood that events may be otherwise determined or suitably recognized and that drilling may be otherwise suitably monitored without departing from the scope of the present invention.

Referring to FIG. 3, the method begins at step 100 with the receipt of reported data by the monitoring system 80, while the rig is operating. The data may be from the lifting gear system 72, the drilling fluid system 74, the rotary system 76, the driller/operator system 78 and/or from other sensors or systems of the drilling rig 10. Some of the data may constitute parameters usable in their present form or format. In other cases, state indicators or other parameters are calculated from the reported data at step 102.

At step 104, the parameters are validated and filtered. Validation may be accomplished by comparing the parameters to pre-determined or dynamically determined limits, and the parameters used if they are within those limits. Filtering may occur via the use of filtering algorithms such as Butterworth, Chebyshev type I, Chebyshev type II, Elliptic, Equiripple, least squares, Bartlett, Blackman, Boxcar, Chebyshev, Hamming, Hann, Kaiser, FFT, Savitzky Golay, Detrend, Cumsum, or other suitable data filter algorithms.

Next, at decisional step 106, for any data failing validation, the No branch of decisional step 106 leads to step 108. At step 108, the invalid data is flagged and recorded in the flag log. After flagging, step 108 leads back to step 100. Determinations based on inputs for which invalid data was received may be omitted during the corresponding cycle. Alternatively, a previous value of the input may be used, or a value based on a trend of the input may be used.

Returning to decisional step 106, for those parameters that are validated, the Yes branch leads to step 110. At step 110, validated and filtered operational parameters may be utilized to determine the state of drilling operations of the rig 10. The drilling state determined at step 110 and data trends may be recorded in the database 96 at step 112. At step 114, drilling state information and operational parameters are utilized to recognize drilling events, as described above.

Proceeding to decisional step 116, if the rig 10 remains in operation, the Yes branch returns to step 100 and continues the method as long as the rig is operational. If the rig 10 is deactivated or otherwise not operational, the No branch of decisional step 116 leads to the end of the process. The process may be operated once or more times per second, or at other suitable intervals. In this way, continuous and real time monitoring of drilling operations may be provided.

Figure 4:
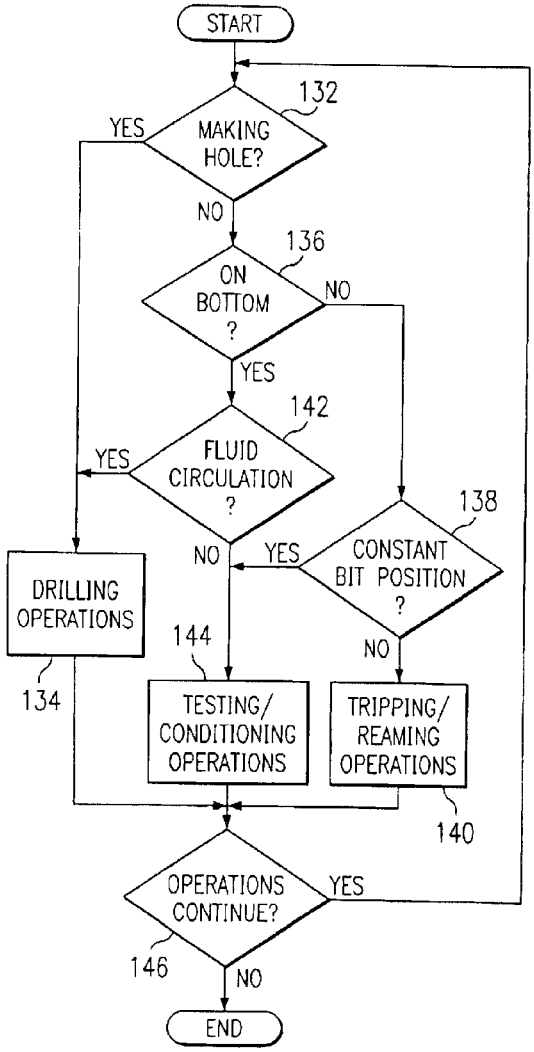
FIG. 4 is a flow diagram illustrating a method for determining the state of a drilling operation in accordance with one embodiment of the present invention.

FIG. 4 illustrates a method for determining the state of drilling operations for the drilling rig 10 in accordance with one embodiment of the present invention. In this embodiment, the drilling states of the drilling rig 10 may comprise and/or be divided into three general categories: (1) drilling; (2) testing/conditioning operations; and (3) tripping/reaming. The drilling state or states include those where the rig 10 is operating so as to drill through the earth or to attempt to do so by the rotation of the drilling bit 40. Drilling may include jetting, or washing, in part, in whole or otherwise as well as any operation operable to bore through the earth and/or remove earth from a bore hole. Jetting may be using mainly hydraulic force for rock destruction. Thus, drilling may include hammer/percussion and laser drilling. It will be understood that unsuccessful drilling may be a separate state or states. The testing/conditioning state or states are operations (other than tripping or reaming operations) used to check or test certain aspects of equipment performance, change out bits, line, or other equipment, change to a different drilling mud, condition a particular part of the bore annulus, or similar operations. The tripping/reaming state or states are operations that include the travel of the bit up or down the already-drilled bore hole.

In the embodiment shown in FIG. 4, four types of state indicators are considered by the drilling state detector 84 in determining the state of drilling operations: (1) whether the rig is "making hole" (substantially increasing the total length of the bore hole), (2) whether the bit is substantially on bottom, (3) whether the bit position is substantially constant, and (4) whether there is substantial circulation of the drilling fluid.

Referring to FIG. 4, the method begins at step 132 in which the parameter calculator 81, drilling state detector 84, or other logic determines whether the drilling rig 10 is making hole. This may be done by determining whether the measured depth of the hole is increasing. If hole is being made, the Yes branch of decisional step 137 leads to step 134. At step 134, the drilling state detector 84 determines that drilling operations are occurring.

Returning to decisional step 132, if hole is not being made, the No branch leads to decisional step 136. At step 136, the detector 84 determines whether the drill bit is at bottom of the bore hole 32. In one embodiment, the drill bit is at the bottom of the bore hole if the measured depth is equal to bit position.

If the bit is on the bottom, the Yes branch of decisional step 136 leads to decisional step 142, where detector 84 determines whether drilling fluid is circulating through the drill string 30, out of the drill bit 40, and through the rest of the fluid system. Parameters used for making this determination may include stand pipe pressure (SPP), strokes per minute (SPM) of the mud pump, total strokes, inflow rate, outflow rate, triptank level, mud pit level, or other suitable hydraulic parameters. A lower limit of these parameters may be chosen for making the determination; for example, experience may show that a SPP of greater than twenty psi is indicative that the drilling fluid is substantially circulating within the hydraulic system.

If circulation is occurring at decisional step 142, detector 84 concludes that drilling operations are occurring, suggesting that relatively strong rock at the bottom of the bore is resulting in a situation where drilling operations are occurring, but little or no hole is being made. Accordingly, the Yes branch of decisional step 142 leads to step 134. Returning to decisional step 142, if there is not circulation, the method concludes at step 144 that the drilling state of the rig 10 is undergoing testing/conditioning operations.

Returning to decisional step 136, if the bit is not on the bottom, the No branch leads to decisional step 138 wherein it is determined whether bit position within the hole is constant; that is, whether the position of the bit relative to the terminus of the bore is remaining constant. If the bit position is constant, the Yes branch leads to step 144 where, as previously described, it is determined that the drilling state of the rig 10 is undergoing testing/conditioning operations. Returning to decisional step 138, if the bit position is not constant, the No branch leads to step 140. At step 140, the drilling state is determined to be tripping and/or reaming operations.

After the drilling state of the rig is determined based on steps 134, 144, or 140, the process leads to decisional step 146, where it is determined whether operations continue. If operations continue, the Yes branch returns to decisional step 132, where the drilling state of the rig continues to be determined as long as the operations continue. If operations are at an end, the No branch of decisional step 146 leads to the end of the process where the drilling state is determined repetitively and/or substantially continuously and in real and/or near real time.

It will be understood that other, additional or a subset of these states may be used for drilling operations. For example, in another embodiment, the states may comprise a drilling/reaming state indicating formation or other material being removed from a bore hole, a tripping state indicating tripping in or out of the hole, a testing/condition state indicating those operations and a connection/maintenance state indicating a process interruption. In still another embodiment, as described in connection with FIG. 5, the state detector 84 may have a high resolution or granularity with five, ten, fifteen or more states. As previously described, the resolution, and thus number and type of states is preferably selected to support control evaluation, decision making and/or provide process evaluation. Process evaluation may be evaluation of parameters, information and other data in the control and decision making context. For example, process evaluation may provide indications and warnings of hazardous events. Data and/or state reporting for archiving may also be provided.

Figure 5A:
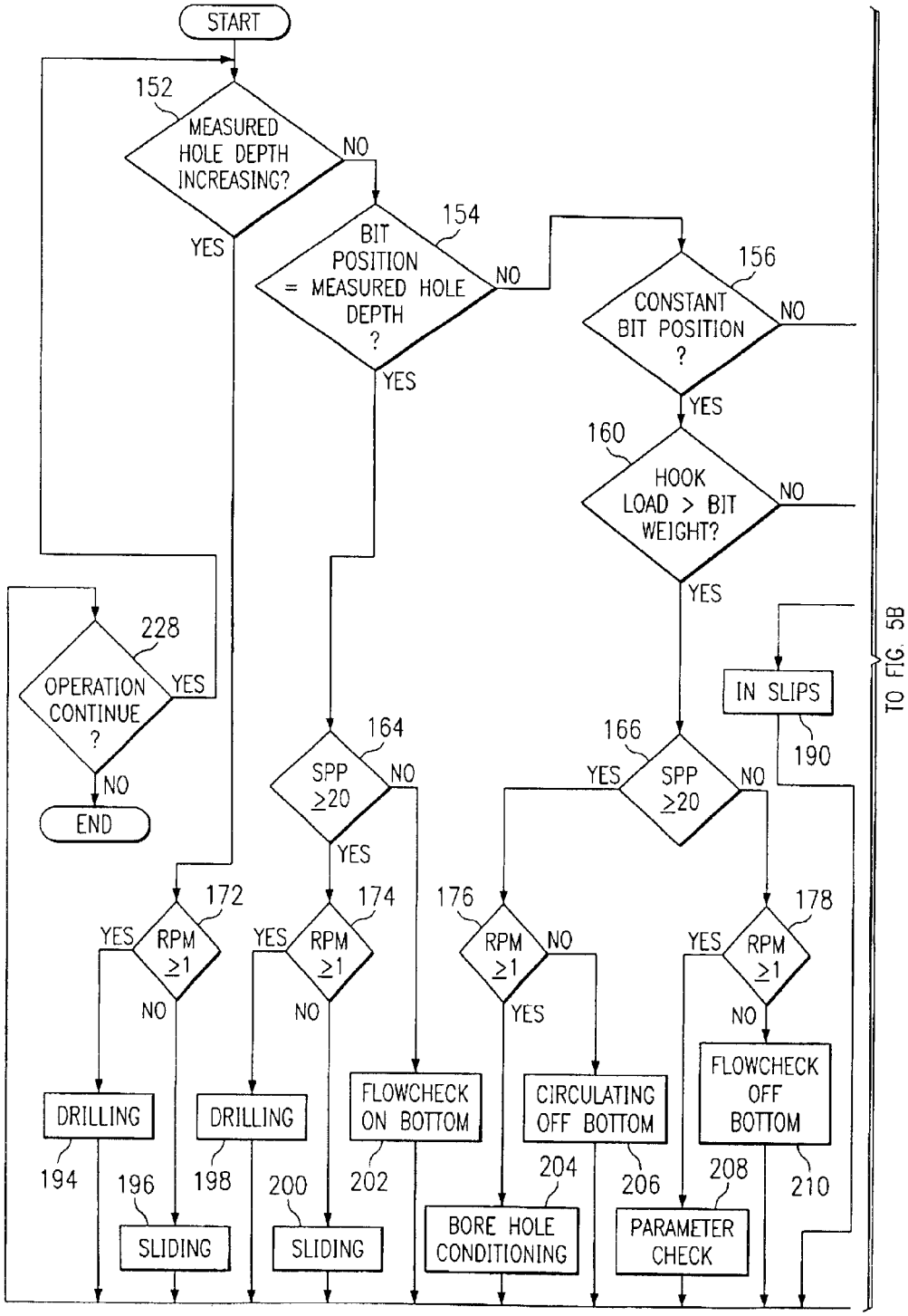
FIGS. 5A–B are flow diagrams illustrating a method for determining the state of a drilling operation in accordance with another embodiment of the present invention.
Figure 5B:
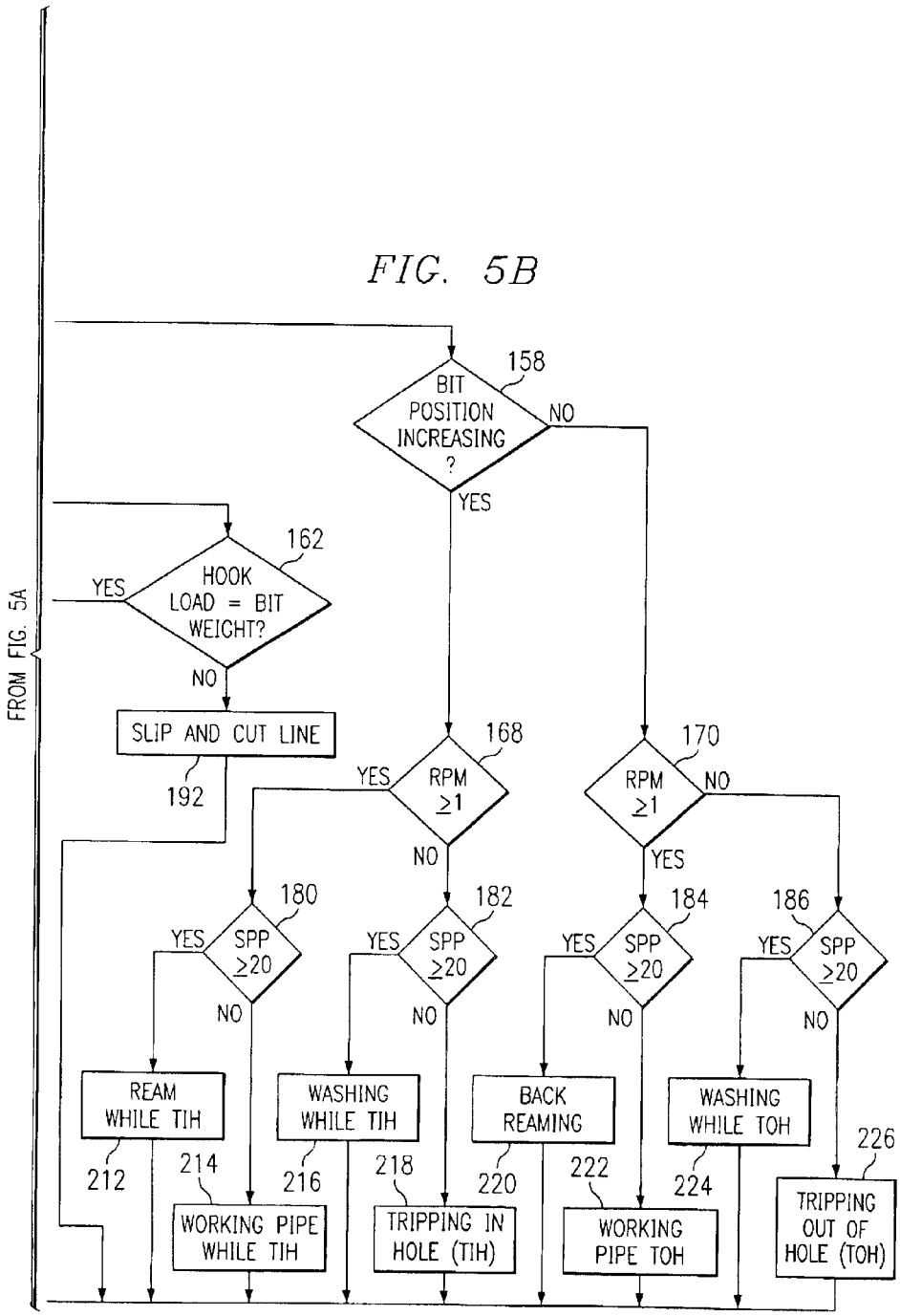

FIGS. 5A–B illustrate a method for determining the drilling state of the drilling rig 10 in accordance with another embodiment of the present invention. In this embodiment, granularity of the drilling states is increased to support enhanced monitoring, reporting, logging and event recognition capabilities. In particular, each of the drilling operations state, the testing/conditioning operations state, and the tripping/reaming operations state are subdivided into a plurality of states.

In one embodiment, drilling state is subdivided into rotary drilling state (stated simply as "drilling" on FIG. 5) and sliding state. Rotary drilling occurs when the rotation of the bit 40 is caused at least in part by the rotation of the drill string 30 which, in turn, is caused by the rotation of the rotary table 56 or other device. In sliding, bit rotation is caused by the operation of a down hole bit motor or turbine rather than by the rotation of the drill string 30. In one embodiment, rotary drilling may include sliding with jetting.

Likewise, testing/conditioning operations are subdivided into an in slips state, a slip and cut line state, a flow check on bottom state, a bore hole conditioning state, a circulating off bottom state, a parameter check state, and a flow check off bottom state.

In slips occurs when the string 30 is set in slips and the string weight is off the hook 24. This state typically occurs during connections and rig-idle situations. Slip and cut line occurs when the string is set in slips and the travelling block assembly is removed so as to, for example, replace worn drilling line. Flow check on bottom occurs when drilling fluid 46 is not circulating and the bit position is on bottom and static. Bore hole conditioning occurs when drilling fluid 46 is circulating, bit position is static and off bottom, and string 30 is rotating. Bore hole conditioning typically occurs when the well bore 32 is being conditioned by cleaning out cuttings or other resistance in the drill pipe/bore-hole-wall annulus. Circulating off bottom occurs when the bit 40 is off bottom, there is no rotation of the string 30, and drilling fluid 46 is circulating. Circulating off bottom typically occurs when mud is changed, fluid pills are placed, or if the well is cleaned out. Parameter check occurs when the string 30 is off bottom and rotating, and drilling fluid 46 is not circulating. Hook load may be measured during parameter check to be used for torque and drag simulations. Flow check off bottom occurs when drilling fluid 46 is not circulating and bit position is static and off bottom. Flow check off bottom typically occurs during a check to determine if the well is flowing (gaining formation fluid) or losing (drilling mud is flowing into formation).

Tripping/reaming operations can be subdivided into a tripping in hole (TIH) state, a tripping out of hole (TOH) state, a reaming while TIH state, a reaming while TOH state, a working pipe state, a washing while TIH state, and a washing while TOH state.

Tripping in hole (TIH) occurs when re-entering a hole after pulling back to the surface. Alone, the term describes TIH with no rotation and no circulation. Tripping out of hole (TOH) occurs when pulling bit off bottom for a short or round trip to surface. Alone, the term describes TOH with no rotation and no circulation. Reaming occurs when the drill bit is moving into the hole, drilling fluid is circulating, and string is rotating. Reaming while TIH is typically used in order to clean out cuttings or other obstructions. Reaming while TOH ("back reaming") is used with dedicated back-reaming tools to clean out sedimented cuttings or obstructions. Working pipe (while TIH or TOH) occurs when the drill bit is moving into the hole, string is rotating, but there is no circulation of drilling fluid. Working pipe is typically used to manage stabilizers or to move the bit past restrictions or ease the movement of the drill string in horizontal well-sections. Washing (while TIH or TOH) occurs when the drill bit is moving into the hole, string is not rotating, and drilling fluid is circulating. Washing while TIH typically is utilized to wash out cuttings before setting the bit on bottom for drilling.

Referring to FIGS. 5A–B, the method begins at step 152 where it is determined, similar to the embodiment described in FIG. 4, whether the rig is making hole. Specifically, step 152 may make this determination by determining whether or not the measured depth is increasing. If measured depth is increasing, the method then determines at step 172 whether the RPM of the rotary table are greater than or equal to one. If the RPM of the rotary table is greater than or equal to one, it is determined at step 194 that rotary table drilling is occurring. If the RPM is less than one at decisional step 172, then it is determined that the rig is sliding.

Returning to decisional step 152, if the measured depth is not increasing, it is next determined at decisional step 154 if the bit position is equal to the measured depth. If the bit position is equal to the measured depth, then at step 164 it is determined whether there is circulation. In the illustrated embodiment, the parameter of stand pipe pressure is used to determine the circulation parameter such that if the stand pipe is greater than or equal to twenty pounds per square inch (psi), then circulation of drilling fluid is determined to be occurring.

At decisional step 174, it is determined whether or not the RPM of the rotary table is greater than or equal to one. Again, if the RPM is greater than or equal to one, the rig is determined to be (rotary table) drilling and if the RPM is not greater than or equal to one, the rig is determined to be sliding in accordance with steps 198 and 200, respectively. Returning to step 164, if the stand pipe pressure is less than twenty psi, then the drilling behavior is determined at step 212 to be flow check on bottom.

Returning to step 154, if the bit position does not equal measured depth, then at step 156 it is determined whether or not the bit position is constant. If the bit position is constant, at step 160 it is next determined whether the hook load is greater than bit weight. If the hook load is greater than bit weight, at step 166 it is determined whether the stand pipe pressure is greater than or equal to twenty psi. If the stand pipe pressure is greater than or equal to twenty psi, then at step 176 it is determined whether the RPM is greater than or equal to one. If the RPM is greater than or equal to one, the drilling behavior is determined to be bottom hole conditioning at step 204. If the RPM is not greater than or equal to one, then, at step 206, the status is determined to be circulating off bottom.

Returning to step 166, if the stand pipe is less than twenty psi, then, at step 178, it is determined whether the RPM is greater than or equal to one. If the RPM is greater than or equal one, at step 208, the drilling behavior is determined to be parameter check. If the RPM is not greater than or equal to one, the drilling behavior is determined at step 210 to be flow check off bottom.

Returning to decisional step 160, if the hook load is not greater than the bit weight, it is next determined at step 162 whether the hook load equals the bit weight. The hook load may equal bit weight if it is the same or substantially the same as the bit weight or within specified deviation of the bit weight. If the hook load equals the bit weight, the drilling behavior is determined to be in slips at step 190. If the hook load does not equal the bit weight, at step 192, the drilling behavior is determined to be in slips with the line cut above the slips.

Returning to decisional step 156, if the bit position is not constant, it is next determined at decisional step 158 whether the bit position is increasing. If the bit position is increasing, then at step 168 it is determined whether the RPM is greater than or equal to one. If the RPM is greater than or equal to one, at step 180 it is determined whether the stand pipe pressure is greater than or equal to twenty psi. If the stand pipe pressure is greater than or equal to twenty psi, the drilling behavior is determined to be reaming while tripping in hole at step 212. If the stand pipe pressure is less than twenty psi, then at step 214 the status is determined to be working pipe while tripping in hole.

If the RPM is less than one at decisional step 168, it is then determined at step 182 whether the stand pipe pressure is greater than or equal to twenty psi. If the stand pipe pressure is greater than or equal to twenty psi, the status is determined to be washing while tripping in hole at step 216. If the stand pipe pressure is less than twenty psi, the status is determined to be tripping in hole at step 218.

Returning to decisional step 158, if the bit position is not increasing, it is next determined at step 170 whether the RPM is greater than or equal to one. If the RPM is greater than or equal to one, at step 184, it is determined whether the stand pipe pressure is greater than or equal to twenty psi. If the stand pipe pressure is greater than or equal to twenty psi, at step 220 the status is determined to be back reaming. If the stand pipe pressure is less than twenty psi, at step 222 the status is determined to be working pipe while tripping out of hole.

Returning to decisional step 170, if the RPM is not greater than or equal to one, at step 186, if the stand pipe pressure is greater than or equal to twenty psi, then the drilling behavior is at step 224 determined to be washing while tripping out of hole. If the stand pipe pressure is less than twenty psi at step 186, the drilling behavior is at step 226 determined to be tripping out of hole. After the drilling behavior has been determined, it is next determined at step 228 whether or not operations continue. If operations continue, then parameters continue to be entered into the system and the determination method continues. If operations are not continuing, then the method has reached its end.

Figure 6:
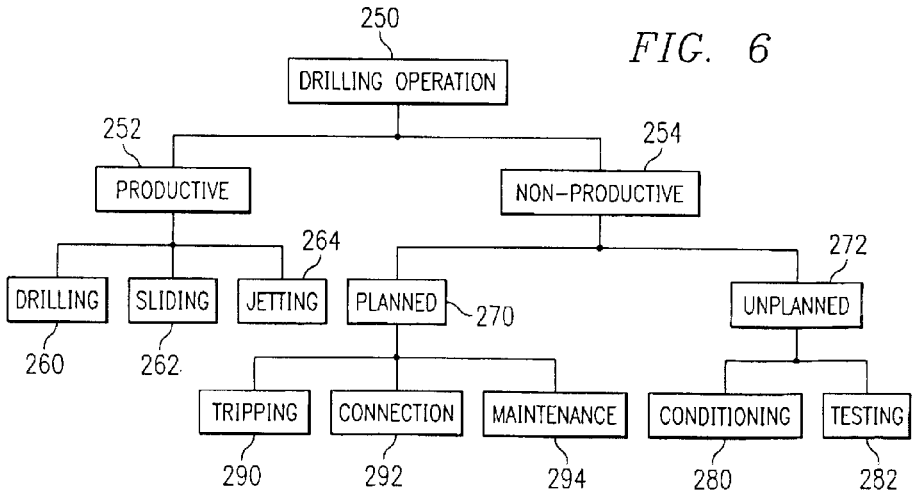
FIG. 6 is a block diagram illustrating states for a drilling operation in accordance with another embodiment of the present invention.

FIG. 6 illustrates states of a well operation in accordance with another embodiment of the present invention. In this embodiment, the state of a drilling or other well operation may include hierarchical states with parent and child states. For example, a drilling or other well operation 250 may have a productive state 252 and a non-productive state 254. For drilling operations, the productive state 252 may include processes in which hole is being made, the bit is advancing or is operated so as to advance. In a particular embodiment, the productive state may include and/or have drilling 260, sliding 262 and/or jetting 264 or combination states as described in connection with FIG. 5. In some drilling embodiments, reaming may be included in the productive state. In other well operations, the productive state may be the state that is the focus or ultimate purpose of the well operation.

The non-productive state 254 may include support or other processes that are planned, unplanned, needed, necessary or helpful to the production state or states. The non-productive state may include and/or have a planned state 270 and an unplanned state 272. For drilling operations, the unplanned state 272 may include and/or have a conditioning state 280 and a testing state 282. The planned state may include and/or have a tripping state 290 as well as a connection state 292 and a maintenance state 294. Maintenance may include rig and hole maintenance. It will be understood that some operations, such as tripping may have aspects in both planned and unplanned states. The states may be determined based on state indicators and data as previously described with the parent and/or child states being determined and used for process evaluation. The parent states may be determined based on the previously discussed state indicators of the included, or underlying, child states, a subset of the indicators or otherwise. Thus, for example, the drilling operation 250 may have the productive state 252 if measured hole depth is increasing or if bit position is equal to measured hole depth and stand pipe pressure is greater than or equal to 20 psi. Maintenance may, for example, include hole maintenance such as reaming and/or rig maintenance such as slip and cut line.

FIG. 7 illustrates a method for event recognition based on well state in accordance with one embodiment of the present invention. In this embodiment, well control events during drilling operations are recognized based on the drilling state determined by the drilling state detector 84. It will be understood that the well control process may itself determine the state of drilling operations and/or use drilling parameters in recognizing events without determination of a drilling state. In addition, the well control process may be used in connection with other suitable well operations and may itself calibrate and validate parameters.

Referring to FIG. 7 the method begins with step 302 wherein the well control module 88 receives new data. The data may comprise validated parameters from the operational system 70 via the parameter validator 82 and information concerning a drilling state from the drilling state detector 84. In one embodiment, the new data is received one or several times each second or each couple of seconds. In this embodiment, the well control module 88 may recognize events in real-time or as they occur and/or in near real time. It will be understood that the rate at which new data is received may be suitably varied.

Proceeding to decisional step 304, the well control module 88 determines whether drilling operations of the rig 10 are in a circulating state. It will be understood that drilling operations may be in the circulating state when drilling fluid is being pumped from the main mud tanks into the drill pipe, or otherwise entering the drill pipe and returning from the annulus. In one embodiment in which the state determination process of FIG. 5 is used, the drilling operations are in the circulating state when in the drilling, sliding, circulating off bottom, reaming while tripping in hole, washing while tripping in hole, or washing while tripping out of hole state, as determined by the drilling state detector 84. Use of the drilling state detector 84 to determine circulation state and other parameters for event recognition may provide the advantage of a modular approach to drilling state operation and event recognition, since any number of event recognition processes may use drilling state information from the process of FIG. 5 in recognizing events.

If it is determined at step 304 that the drilling operation is in the circulation state then, at step 306, a relative flow value may be determined. In a particular embodiment, the relative flow value may comprise a ratio between drilling fluid added to the well bore by the rig 10 and drilling fluid received by the rig 10 from the well bore. Flow into the well bore may be determined from strokes per minute and/or stand pipe pressure. Flow out of the well bore may be determined from the volume entering the mud tank, which may be determined from paddle movement. In a particular embodiment, the ratio, termed $K_{flo}$, is the flow of drilling fluid out of the well bore to the mud tanks over the flow of the drilling fluid into the well bore from the mud tanks. The formula for $K_{flo}$ can be expressed as follows, where $Flow_{out}$ is the flow of drilling fluid out of the well bore to the mud tanks and $Flow_{in}$ is the flow of the drilling fluid into the well bore from the mud tanks:

$$K_{flo}=[Flow_{out}/Flow_{in}]$$

$K_{flo}$ is a unitless parameter that may be normalized to any suitable range. An increase or gain in $K_{flo}$ signifies an increase in the flow out of the well bore to the mud tanks relative to the flow into the well bore from the mud tanks. A decrease, or loss in the $K_{flo}$ signifies a decrease inflow out of the well bore to the mud tanks relative to the flow into the well bore from the mud tanks. Theoretically, under stable flow conditions, the ratio of inflow over outflow would be unity; however, the value of benchmark $K_{flo}$ in the present method may be a number other than 1.0. By calculating benchmark $K_{flo}$ with a statistical fit to actual flow in and flow out data for the particular drilling conditions at that time, as described in reference to FIG. 8, the present method automatically takes into account sensor imperfections and other biases in the data. $K_{flo}$ is also illustrated and further described in connection with FIG. 9.

As described in further detail below in reference to FIG. 8, the well control module 88 may perform an initial calibration process. Upon startup of rig operations, $K_{flo}$ and other parameters may vary greatly before settling into relatively stable, steady state flow conditions. Calibration may comprise determining an initial $K_{flo}$ benchmark upon reaching stable, steady state flow conditions. Because the relative flow value may fluctuate during normal conditions (no inflow into the well from subsurface formations and no outflow from the well into subsurface formations) due to sensor imprecision, mechanical and/or hydraulic noise, or other factors, the calibration may also comprise determining normal variation of the relative flow value from the benchmark. Gain and/or loss limits on variation may then be determined, to be compared against actual flow conditions. As described further below, determining limits on variation may comprise calculations made real time and/or may comprise the retrieval of pre-defined values. In a particular embodiment, a gain limit may comprise one standard deviation from benchmark $K_{flo}$. Calibration may also be performed at certain pre-set or other intervals of time. Alternatively, the user may at any appropriate time request calibration. In other embodiments, such as where flow parameter limits are predefined, calibration may be omitted.

Proceeding to step 308, the well control module 88 determines whether the $K_{flo}$ values continue to reflect relatively stable, steady state flow conditions. Relatively stable, steady state flow conditions may comprise variations limited to those expected from mechanical noise, sensor imprecision, and other normal fluctuations, and may be considered to comprise "safe" flow conditions. If the well remains in relatively stable, steady state flow conditions, the Yes branch of decisional step 308 leads to step 310. At step 310, benchmark $K_{flo}$ values and allowable limits alarm may be re-calibrated, re-calculated, or otherwise updated.

Returning to decisional step 308, if the value of $K_{flo}$ indicates departure from steady state conditions, the No branch proceeds to step 312. At decisional step 312, it is determined whether the current $K_{flo}$ value exceeds the gain limit on variation established during calibration. If the limit on gain variation is exceeded then inflow is occurring and the Yes branch leads to step 318. An inflow event is flow, or gain of drilling fluid into the well bore from the surrounding formation(s). Inflow may be caused by, for example, unexpectedly high subsurface pressures or other causes.

At step 318, the well control module 88 may initiate a determination of cumulative inflow. In one embodiment, the cumulative inflow is based on variations of current relative flow values from benchmark $K_{flo}$. In this embodiment, cumulative flow variation ($K_{flo}$(cum)) may be determined based upon a cumulative summation of deviations from benchmark $K_{flo}$ since the first gain limit exceedance. In other embodiments, well control sub-module 88 may continually or otherwise track cumulative sum and/or determine the cumulative sum of inflow, or may be determined based on other parameters. $K_{flo}$(cum) is illustrated and further discussed in FIG. 9.

Next, at decisional step 320 the well control module 88 determines whether an inflow flag level has been exceeded. An inflow flag level may comprise a pre-set or otherwise suitably determined level of $K_{flo}$(cum). In a particular embodiment for shallow offshore wells, the inflow flag level may comprise a cumulative deviation from benchmark $K_{flo}$ that is equivalent or corresponds directly or indirectly to a pre-selected fluid volume, which in a particular embodiment is five barrels of mud. If the inflow flag level has not been exceeded then the inflow is minimal and flagging is unnecessary. Thus, the No branch of decisional step 320 returns to data receipt step 302 and the process is repeated. If the inflow flag level has been exceeded at decisional step 320, then the Yes branch leads to step 322 where an inflow event is flagged. The inflow event may be flagged by audible and/or visual warning signal. Visual warning signal may be given at the display alarm module 97. An inflow flag may be considered to be a "yellow alarm"—not yet at the "red alarm" level of a kick, but nevertheless placing the operator on notice of a potential well control problem. A kick comprises a severe inflow condition that may constitute an immediate danger to the rig 10 and to the safety of the rig crew.

At step 324, the kick flagging level is determined. A kick comprises a severe, "red flag" inflow condition that may constitute an immediate danger to the rig 10 and to the safety of the rig crew. A kick flagging level may be pre-determined or may be dynamically determined based upon varying drilling data and parameters. In a particular embodiment, described further below, the kick flagging level may initially be predetermined, and then dynamically adjusted based upon outputs from the fuzzy logic processor 87.

The fuzzy logic processor 87, described above in reference to FIG. 2, may consider a variety of inputs that directly indicate or confirm an actual inflow as well as inputs that influence the direct indicators. Thus, the fuzzy logic processor 87 may consider first order or other primary indicators and also secondary indicators that affect the primary indicators and may account for a change in a primary indicator that would otherwise indicate an inflow. In one embodiment, inputs may comprise drilling state (from the drilling state detector 84), stand pipe pressure (SPP), pump strokes per minute (SPM), magnitude and rate of departure of $K_{flo}$ from benchmark, weight on bit (WOB), and pit volume.

In this embodiment, a drop in SPP may be an indication of lighter formation fluid in the annulus and thus confirm an inflow event. Changes in SPM may verify if a drop in SPP is caused by pump failure or other pump problems as applied to an inflow. The magnitude and rate of departure of $K_{flo}$ from benchmark may indicate the severity of the inflow situation and tend to confirm the existence of an inflow. Changes in WOB may have impact on SPP and thus may need to be taken into account when considering the effect of a change in SPP. And, a gain or loss in active pit volume may serve as an additional indication of a kick event.

Another input to the fuzzy logic processor 87 in a particular embodiment may be "D-exponent," a commonly used equation for abnormal pressure analysis during drilling operations. An equation for D-exponent is:

$$D\text{-exponent}=(\log(R/N))/(\log(W/D_B))$$

where R=drilling rate (ft/hr), N=rotary speed (RPM), W=bit weight (lbs), and $D_B$=bit diameter (inches). Alternatively, a simplified version of the D-exponent formula may be used, such as:

$$D\text{-exponent}=R/W$$

D-exponent may be used in the fuzzy logic processor 87 to compare rate of penetration by filtering out driller variation of WOB, RPM, and SPM. A drilling break may be indicated by an increase in D-exponent and may constitute an indication of inflow.

The drilling state from the drilling state detector 84 may also comprise an input to the fuzzy logic processor 87. For example, a sliding drilling state may reflect higher WOB and results in increased pressure response and helps evaluating the impact of the pressure response, since during sliding drilling pump pressure may be more sensitive to weight-on-bit changes, as a result of increased motor pressure needed to overcome increased bit torque. Thus, a drop in stand pipe pressure, usually an indication for formation inflow, can also be caused by reduction in weight-on-bit and should be regarded as not the result of formation inflow if bit weight is decreasing simultaneously.

Outputs from the fuzzy logic processor 87 may comprise "confidence levels" expressed from 0.0 to 1.0. A confidence level of 1.0 indicates high confidence that the inflow level which triggered the inflow flag may in fact comprise a kick, and the kick alarm level may be adjusted downward so as to result in an almost immediate kick alarm after the inflow alarm. A confidence level of less that 1.0 indicates a lower level of confidence that the inflow flagging level exceedance is indicative of a kick.

For example, in a particular embodiment, inflow flagging levels may be pre-set at five barrels above benchmark, and kick flagging levels may be initially set at ten barrels above benchmark. The kick flagging level is then adjusted based on the confidence level. In one embodiment, the kick flag level is reduced by an amount equal to the confidence value output of the fuzzy logic controller multiplied by the difference between the kick flagging level and the inflow flagging level (in this case, five barrels (10−5=5). Thus, a confidence level of 0.5 would result in a 2.5 barrel adjustment of the kick flagging level, such that the kick flagging level would be set at 7.5 barrels. As additional data is received by the fuzzy logic controller, the kick flagging level may be further adjusted. In this way, the present system and method provides a dynamic method of well control event recognition which takes into account a multitude of real-time factors. In addition, the consideration of primary and secondary inputs allows the evaluation of inflow indicators in the context of the complex system and operations of the rig and thus reduce or eliminate false confirmations and allow alarming at lower inflow levels with higher confidence. Well control event recognition, and in particular inflow and kick flag levels, are illustrated and further discussed in connection with FIG. 9.

In a particular embodiment, in addition to the automatic inputs to the fuzzy logic processor, the operator may manually input parameters in response to a prompt or at other suitable times. Manually inputted parameters may comprise drilling parameters, operations, or data not automatically accounted for by the monitoring module 80. For example, the operator may input to the fuzzy logic processor any recent additions or removals of mud to or from the mud pit.

At decision step 326 it is determined whether the kick flag level determined at step 324 has been exceeded. If the kick flag level has not been exceeded, the No branch returns to step 302. If the kick flag level has been exceeded then the Yes branch of decisional step 326 leads to step 328. At step 328, a visual and audible kick alarm is given via the display/alarm module 97.

Returning to step 312, if it is determined that the gain limit has not been exceeded, the No branch leads to step 314. At step 314 it is determined whether the current relative flow value exceeds the loss limit in variation. If the variation loss limit is not exceeded, then the method returns to data receipt step 302.

If at step 314 it is determined that the variation loss limit is exceeded, the Yes branch leads to step 315. At step 315, the well control module 88 may initiate a determination of cumulative flow variation. As above, in one embodiment, the cumulative flow variation is based on variations of current relative flow values from benchmark $K_{flo}$.

Next, at decisional step 316 the well control module 88 determines whether an outflow flag level has been exceeded. An outflow flag level may comprise a pre-set or otherwise suitably determined level of $K_{flo}$(cum). In a particular embodiment, the outflow flag level may comprise a cumulative deviation from benchmark $K_{flo}$ equivalent or corresponding to a pre-selected fluid volume, which in a particular embodiment is five barrels of mud. If the outflow flag level has not been exceeded then the outflow is minimal and flagging is unnecessary. Thus, the No branch of decisional step 316 returns to data receipt step 302 and the process is repeated. If the outflow flag level has been exceeded at decisional step 316, then the Yes branch leads to step 317 where an inflow event is flagged. An outflow event is flow, or loss drilling fluid from the well bore to surrounding formation(s). An event may be flagged by an alarm. An "alarm" may include any audible, verbal, visual, oral or other notification, an interruption, a notation, a recording, or another suitable indication of the event. After flagging at step 317, the method returns to step 302 where the process is repeated.

In a particular embodiment, the well control module may be operable to determine that a particular exceedance of the gain limit or a particular departure from stable flow conditions was an anomaly and not due to well inflow or kick events, and/or that the well has since returned to stable flow conditions. For example, in a particular embodiment, after an exceedance of a gain limit, a pre-selected number of iterations of received data which do not exceed the gain limit may indicate that the prior exceedance was an anomaly. In a particular embodiment, thirty iterations of received data which do not exceed the gain limit may indicate that the prior exceedance was an anomaly. If the specified number of non-exceedances have occurred after a gain limit exceedance, the well control module may reset the value of $K_{flo}$(cum) calculated pursuant to step 320 to zero.

Returning to decisional step 304, if it is determined that the drilling rig 10 is not in a circulating state, the No branch of decisional step 304 leads to step 330. At step 330, it is determined whether the drilling rig 10 is in a constant bit position (constant BPOS) state. A constant BPOS state may comprise slip and cut line, flow check on bottom, parameter check, or in slips state, as determined by the drilling state detector 84. The constant BPOS state may be otherwise suitably determined.

If the rig 10 is in a constant BPOS state while not circulating as determined by step 304, no flow from the well bore should be detected and the volume in the mud tanks should not be changing and the Yes branch leads to step 332. At step 332 it is determined whether the volume of drilling fluid in the mud tank and/or well bore is changing. A change in drilling fluid volume in the mud tank may be determined from change in tank level. A change in drilling fluid volume in the well bore may be determined from a flow sensor. In one embodiment, the fluid volume is changing when any indicated change is outside the normal range of sensor detection caused by sensor imprecision, mechanical and hydraulic noise and/or other to-be-expected conditions.

If the volume of drilling fluid is not changing, then no inflow or outflow between the well bore and the formation is occurring and the No branch of decisional step 332 returns to data receipt step 302. If the volume of drilling fluid is changing, then the Yes branch of decisional step 332 leads to step 333. At step 333 it is determined whether the fluid volume in the mud tanks and/or well bore is increasing or decreasing. If the volume is increasing, the Yes branch of decisional step 333 leads to step 334. At step 334, inflow is flagged. An alarm may be given at the display/alarm module 97 and the process returns to data receipt step 302. If the volume of drilling fluid is decreasing, the No branch of decisional step leads to step 335. At step 335, outflow is flagged and the process returns to data receipt step 302

Returning to decisional step 330, if the drilling rig is not in a constant BPOS drilling state while not circulating, then the rig 10 is tripping and the No branch leads to step 336. At decisional step 336 it is next determined whether the rig is in a tripping-out-of-hole state. A tripping-out-of-hole state may comprise tripping out of hole or working pipe while tripping out of hole, as determined by the drilling state detector 84. Pipe removed in tripping-out-of-hole may be sectioned pipe or coiled tubing. The tripping-out-of-hole state may be otherwise suitably determined.

If the drilling rig 10 is in a tripping-out-of-hole state, then the Yes branch of decisional step 336 leads to decisional step 346. At step 346 it is determined whether the displacement of drilling fluid during tripping is within the trip limits. This limit may be dynamic or predefined. In one embodiment the limits are expected and an indicated displacement may depend on the accuracy with which the change in drill string, which may in some embodiments be coiled tubing, volume in the hole can be determined, the variation caused by the movement of the downhole assembly and string, and other variations caused by the pumping of drilling fluid from and into the triptanks, and by the background amount of flow variation caused by sensor imprecision, mechanical and hydraulic noise and/or other to-be-expected conditions.

Displacement may be determined by the change in volume of drill pipe in the well bore relative to the change in volume of drilling fluid in the well bore. Thus, for tripping out operations in which drill pipe is pulled out of the well bore in sections or lengths of tubing, expected displacement of drilling fluid into the well bore is a volume equal to the value of drill pipe removed. Value of drilling fluid added to well bore may be determined from the decrease in the level of the trip tank. Volume of the drill pipe removed may be determined from the length of pipe removed.

At step 346, if the displacement is within displacement limits, then no inflow or outflow is occurring and the Yes branch of decisional step 346 returns to data receipt step 302. If displacement is outside the limits, the No branch of decisional step 346 leads to step 348. At decisional step 348 it is next determined whether the displacement constitutes a gain in drilling fluid. If the displacement constitutes a fluid gain, then fluid is flowing into the well bore from the surrounding formation(s) and the Yes branch leads to step 350. At step 350 an inflow event may be flagged at the alarm/display module 97. If the displacement does not comprise a fluid gain, then fluid loss is occurring and the No branch of step 348 leads to step 352 wherein an inflow is flagged.

Returning to decisional step 336, if the drilling rig is not in a tripping-out-of-hole state, then it is tripping into the hole and the No branch leads to decisional step 360. At decisional step 360, it is determined whether any displacement of drilling fluid is within the limits of variation caused by any in-tripping operations. As described in connection with decisional step 346, this limit may be dynamic or predefined. If the displacement is within limits, then the process returns to data receipt step 302. If displacement is substantial (in other words, if the displacement exceeds the expected or a specified gain or loss limit), then it is next determined whether the displacement constitutes a gain in drilling fluid at step 362. If the displacement constitutes a gain in drilling fluid, then an inflow event is flagged per step 364. If the displacement does not constitute a gain in drilling fluid then an outflow event is flagged per step 366 As previously described, flags may be a notation or recording in a file or database and/or an alarm or other human notable indication.

Figure 8:
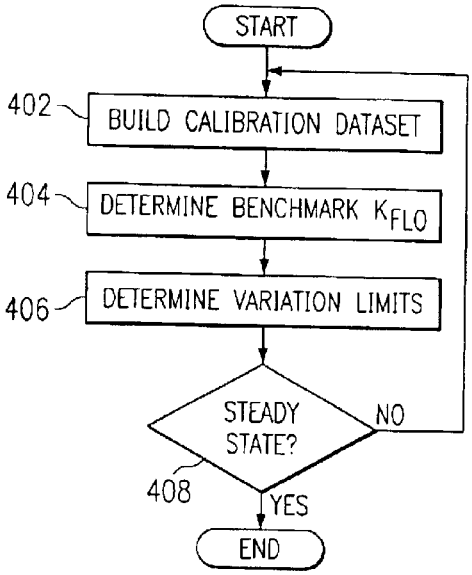
FIG. 8 is a flow diagram illustrating a method of calibrating an event recognition process in accordance with one embodiment of the present invention.

FIG. 8 illustrates a method of calibrating the well control module 88 for well control event recognition during drilling operations in accordance with one embodiment of the present invention. In this embodiment, the relative flow volume is based on $K_{flo}$.

Referring to FIG. 8, the method begins at step 402 wherein the well control module 88 builds a calibration data set comprising sufficient hydraulic and mechanical data. Initially upon startup of the mud pumps, the data may vary widely; however, as the circulation approaches relatively stable, steady state flow conditions, variations in the data may decrease until the variations reflect mechanical noise and other aspects of normal operations. The data may be statistically smoothed using an appropriate filter. At step 404, the benchmark $K_{flo}$ is determined. In one embodiment, benchmark $K_{flo}$ is calculated using a least square regression fit of inflow and outflow over several minutes or other suitable period of time. Theoretically, under stable flow conditions, the ratio of inflow over outflow would be unity; however, the value of benchmark $K_{flo}$ in the present method may be a number other than 1.0. By calculating benchmark $K_{flo}$ with a statistical fit to actual flow in and flow out data for the particular drilling conditions at that time, the present method automatically takes into account sensor imperfections and other biases in the data.

Proceeding to step 406 the limits of variation under relatively steady state flow conditions are determined. In one embodiment, the variation limits are set at or just greater than the one standard deviation from benchmark $K_{flo}$. The gain limit and the loss limit may be of the same or of a different magnitude. In a particular embodiment, the gain limit may be set at about one standard deviation and the loss limit may be set at about 1.5 standard deviations. These calibrated gain and loss limit values may be used as described in reference to FIG. 7.

After determination of benchmark $K_{flo}$ and of variation limits at steps 404 and 406, the initial calibration may be completed if the data continues to reflect relatively steady state conditions, and thus the Yes branch of decisional step 408 leads to the end of the method. In a particular embodiment, well control event recognition may then proceed as described in reference to FIG. 7 or with other suitable methods, and benchmark $K_{flo}$ and variation limits may be updated upon the receipt of additional data as described in reference to step 310 of FIG. 7 or at other suitable times or with other suitable methods. However, if relatively stable, steady state flow conditions do not yet exist, then initial calibration is not yet complete and the No branch of step 408 leads back to step 402.

Figure 9:
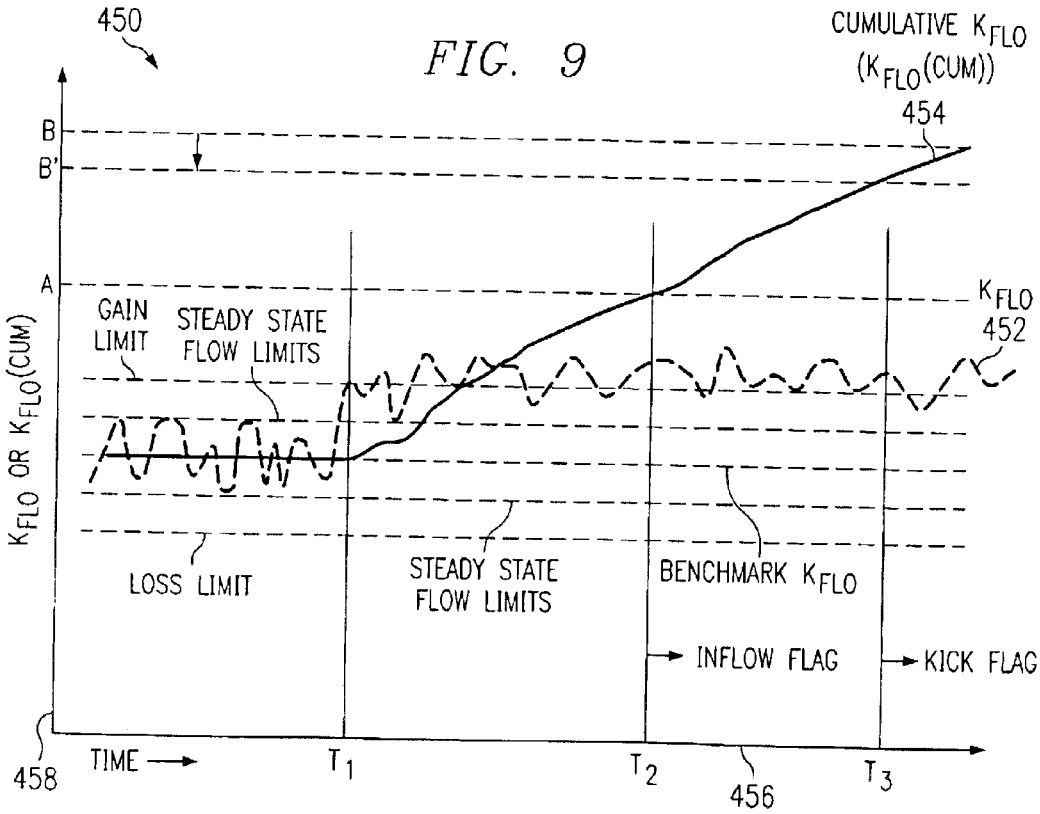
FIG. 9 is a graph illustrating event recognition during circulation conditions of drilling operations in accordance with one embodiment of the present invention.

FIG. 9 illustrates event recognition during circulation states of drilling operations in accordance with one embodiment of the present invention. In the illustrated embodiment, well control events are recognized under circulating conditions as described in reference to FIG. 7.

Referring to FIG. 9, an exemplary plot 450 of $K_{flo}$ 452 and $K_{flo}$(cum) 454 is shown. The horizontal axis 456 constitutes time and the vertical axis 458 constitutes a value of $K_{flo}$ 452 and $K_{flo}$(cum) 454 as described above in reference to FIG. 6. $K_{flo}$ 452 may be a unitless value, and $K_{flo}$(cum) 454 may be expressed in terms of standard deviations or in volumetric terms.

For the illustrated example, during the period of time prior to time $T_1$ the overall flow is stable, although there is some fluctuation due to hydraulic and mechanical noise, sensor imprecision, and other factors. During such relatively stable, steady state flow conditions, the value of $K_{flo}$ 452 fluctuates around a benchmark $K_{flo}$ 452 and within a range marked by the steady state flow variation limits. In the illustrated embodiment, the gain and loss limits are set as being equal to one standard deviation from benchmark $K_{flo}$.

In the illustrated embodiment, $K_{flo}$(cum) is not calculated as long as the value of $K_{flo}$ remains within the gain variation limits. At time $T_1$ the value of $K_{flo}$ 452 exceeds for the first time the gain limit, and the well control module 88 may begin calculating $K_{flo}$(cum) 454. $K_{flo}$(cum) may be determined based upon a cumulative summation of deviations from benchmark $K_{flo}$ since the first gain limit exceedance.

Inflow flag level "A" may comprise a pre-set level of $K_{flo}$(cum), for example, a cumulative deviation from benchmark $K_{flo}$ equivalent to five barrels of mud. At time $T_2$, the inflow flag level has been exceeded, and the inflow event may be flagged by audible and/or visual warning signal.

Upon exceedance of the inflow flag level at time $T_2$, the kick flagging level may be determined. In the illustrated embodiment, the kick flagging level is initially determined as the preset value "B." As described above in reference to FIG. 7, the kick flagging level may be dynamically adjusted based upon outputs from the fuzzy logic processor 87. In the illustrated embodiment, the kick flagging level is adjusted to a new level, "B'", as the output of the fuzzy logic controller reflects increased confidence that the inflow event comprises an actual and/or imminent kick event. At time $T_3$, adjusted kick flagging level B'°has been exceeded, and a visual and audible kick alarm is given via the display/alarm module 97. In other embodiments, both alarm limits may be preset.

Figure 10:
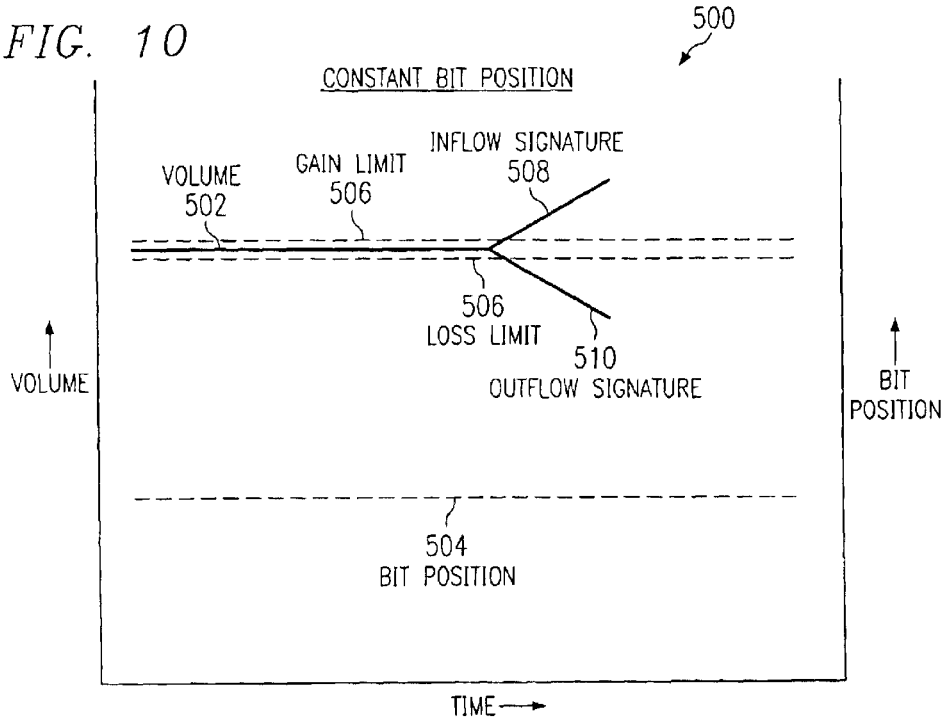
FIG. 10 is a graph illustrating event recognition during a non-circulation, constant bit position state of drilling operations in accordance with one embodiment of the present invention.

FIG. 10 illustrates event recognition during a non-circulation, constant bit position state of drilling operations in accordance with one embodiment of the present invention. In this embodiment, drilling fluid volume is determined based on the level of fluid in the mud tanks and/or the well bore.

Referring to FIG. 10, an exemplary plot 500 indicates an overall volume of drilling fluid in the mud tanks 48 and/or the well bore 32 over time. In the illustrated example, during normal conditions the volume 502 remains relatively constant as the bit position 504 remains constant within upper and lower limits of deviation 506 caused by sensor imprecision and/or mechanical and hydraulic noise. During an inflow event 508, the deviation exceeds the gain limit. During an outflow event 510, the deviation exceeds the loss limits. Both events, if they occur, may be flagged as previously described.

Figure 11:
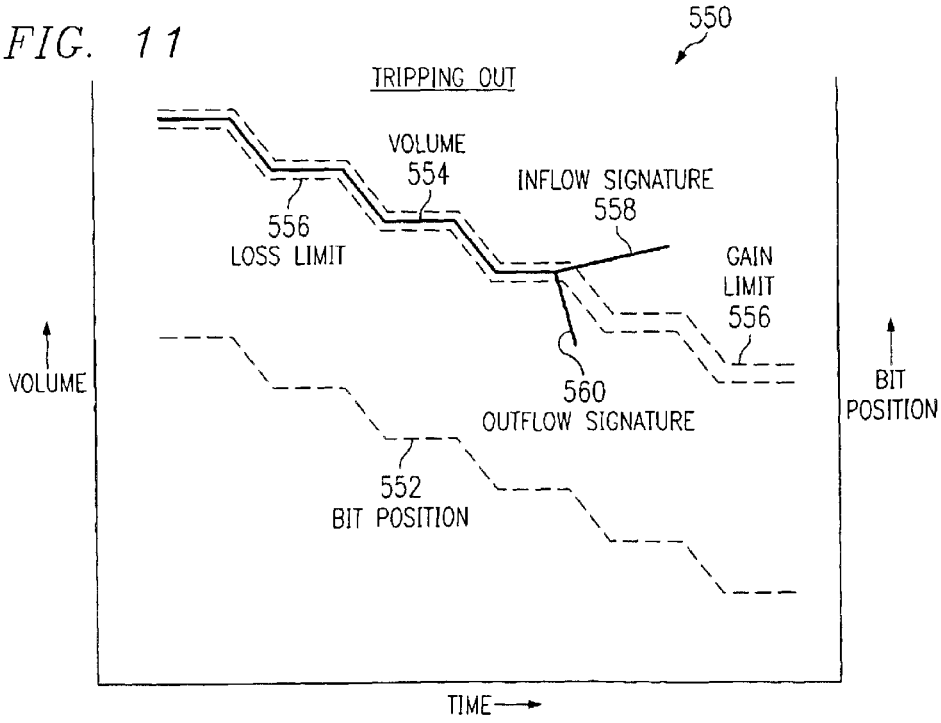
FIG. 11 is a graph illustrating event recognition during a non-circulation tripping-out state of drilling operations in accordance with one embodiment of the present invention.

FIG. 11 illustrates event recognition during a non-circulation tripping-out state in accordance with one embodiment of the present invention. In this embodiment, drilling fluid volume is determined based on level of fluid in the mud tanks 48 and/or the well bore 32.

Referring to FIG. 11, an exemplary plot 550 indicates the bit position 552 as the drill string and down hole assembly are removed from the well bore 32 during tripping-out operations. For segmented drilling string, as each segment is removed from the well bore, the segment must be moved from the drill string resulting in intervals of time where the bit position 552 does not change. This results in the characteristic stair step profile of the bit position. For coiled tubing, the bit position 552 may have a linear profile over time.

The volume of drilling fluid 554 reflects this bit position movement and removal of drilling string segments. The change in volume 554 closely tracks the change in bit position within upper and lower limits 556 caused by sensor imprecision, mechanical noise, and/or hydraulic noise. An increase in fluid volume caused by an inflow event 558 causes the volume to exceed the gain limit variation. A decrease in fluid volume caused by an outflow event 560 causes the value to exceed the loss limit variation. Both events, if they occur, may be flagged as previously described.

Figure 12:
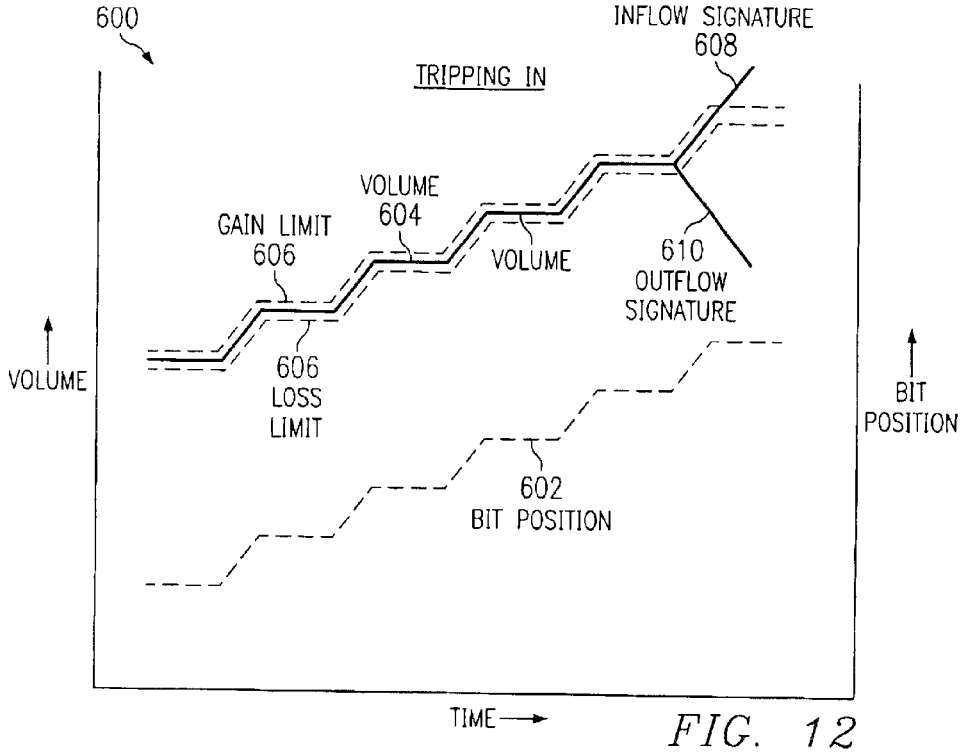
FIG. 12 is a graph illustrating event recognition during a non-circulation tripping-in state of drilling operations in accordance with one embodiment of the present invention.

FIG. 12 illustrates event recognition during non-circulation tripping-in states of drilling in accordance with one embodiment of the present invention. In this embodiment, drilling fluid volume is determined based on level of fluid in the mud tanks 48 and/or the well bore 32.

Referring to FIG. 12, an exemplary plot 600 indicates increases in bit position 602 as the drilling string and down hole assembly are lowered into the well bore. Intervals of time are shown wherein the bit position 602 has not increased due to new drilling string segments must be added to the string, thus resulting in the stair step profile. For coiled tubing, the bit position 602 may have a linear profile over time.

The change in volume 604 closely tracks the change in bit position within upper and lower limits 606 of variations caused by mechanical and hydraulic noise. During an inflow event 608, the volume exceeds the gain limit of variation. During an outflow event 610, the volume exceeds the loss limit of variation. Both events, if they occur, may be flagged as previously described.

In each of FIGS. 9–12, the values of bit position and fluid volume may be sensed and/or determined from sensed data. The limits may be predefined or dynamic as a deviation of bit position or other variable. The fluid volume is electronically or otherwise compared to the limits by the well control module 88, which may flag fluid volumes outside limits. The data may be logged, recorded, reported, plotted and/or displayed graphically or otherwise.

Figure 13:
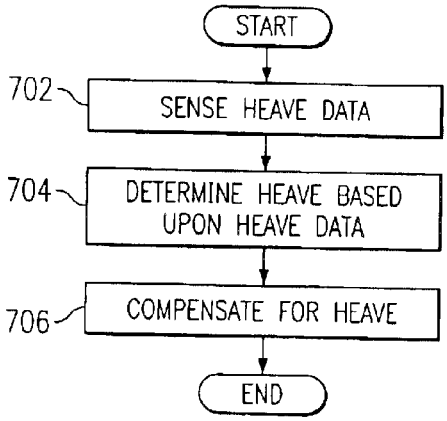
FIG. 13 is a flow diagram illustrating a method of compensating for heave of a drilling ship or for similar movement during event recognition.

FIG. 13 is a flow diagram illustrating a method of compensating for heave of a drilling ship or for similar movement during state determination, event recognition, or other operations. When drilling from a ship, floating platform, or other platform that may be subject to vertical movement or other displacement caused by waves, tides, or other causes, the displacement may cause variation in mud tank volume or in other data streams utilized during event recognition. For example, vessel motion caused by waves may cause displacement from the riser-DP annulus into the mud pits which is not originating from the formation. Therefore, it may be desirable to detect, quantify, and compensate for heave and/or for similar non-well-control-event related displacement.

Referring to FIG. 13, the method begins with step 702 wherein heave or other displacement data is sensed. Sensing of such displacement may be via compensator bottle pressure changes, string tension in the tensioner, accelerometers on the derrick, proximity switches on the slip joint, or other suitable means to sense and/or infer displacement. At step 704, the effect of heave on data utilized during event recognition may be determined and/or quantified. For example, heave due to vessel movement may be periodic or follow particular wavelengths or frequencies depending upon the state of the sea, or may vary with little or no repeatable pattern.

Proceeding to step 706, the heave component of the well control data is compensated for. For example, deviations from predefined limits may be noted, a determination made of whether the deviation is caused by heave, and the deviation disregarded if the deviation is caused by heave (and not by a well control event). Alternatively, the sensitivity of the event recognition algorithm may be reduced by, for example, changing the gain and loss limits to reflect increased variation due to heave. In another embodiment, calculations of mud tank volumes or other data used in event recognition may be adjusted, in real time or otherwise, for the displacement. For example, during non-bit movement states, heave effects could be quantified and mud volumes calculations calibrated so as to negate the effect of heave.

Figure 14A:
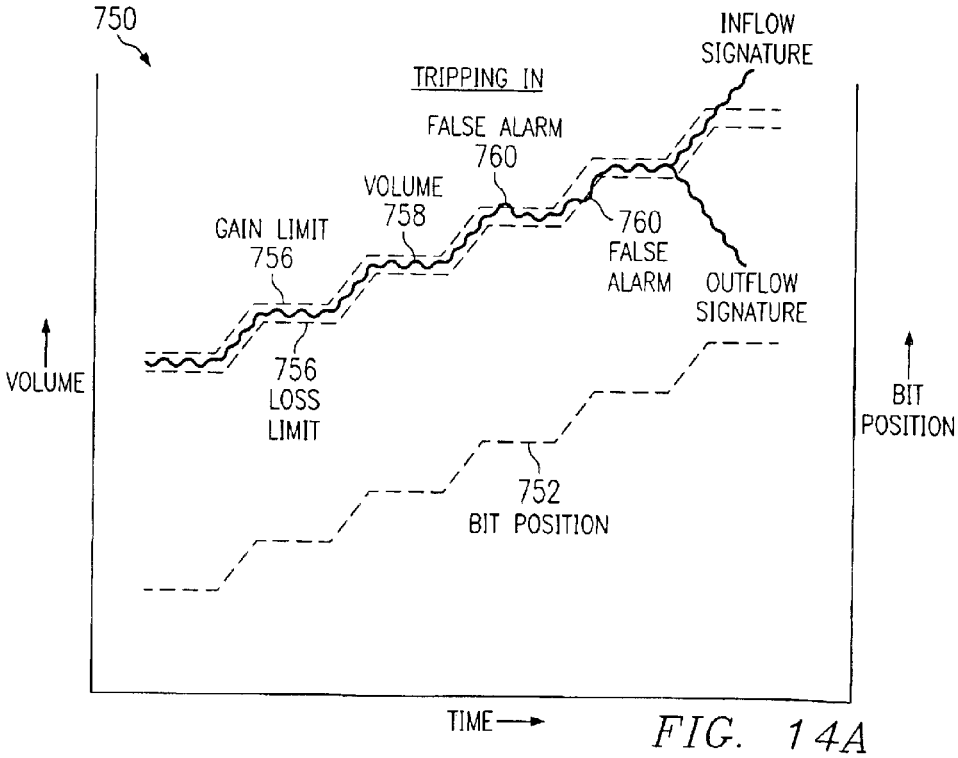
FIGS. 14A–C are graphs illustrating the effect of heave compensation as part of event recognition during a non-circulation tripping-in state of drilling operations in accordance with various embodiments of the present invention.
Figure 14B:
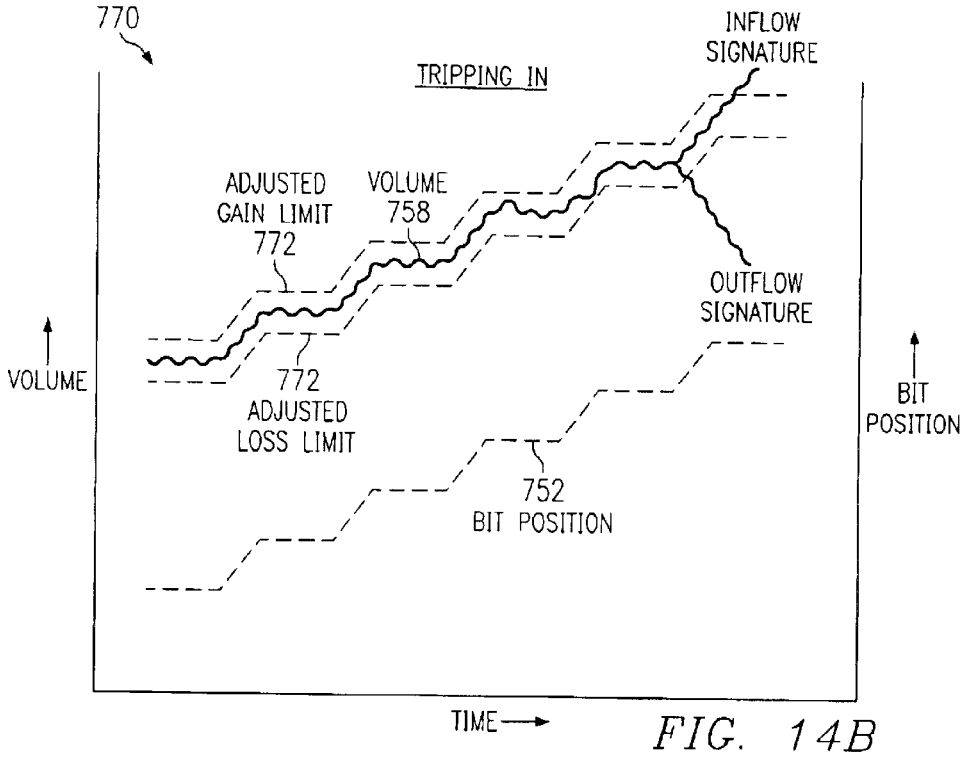
Figure 14C:
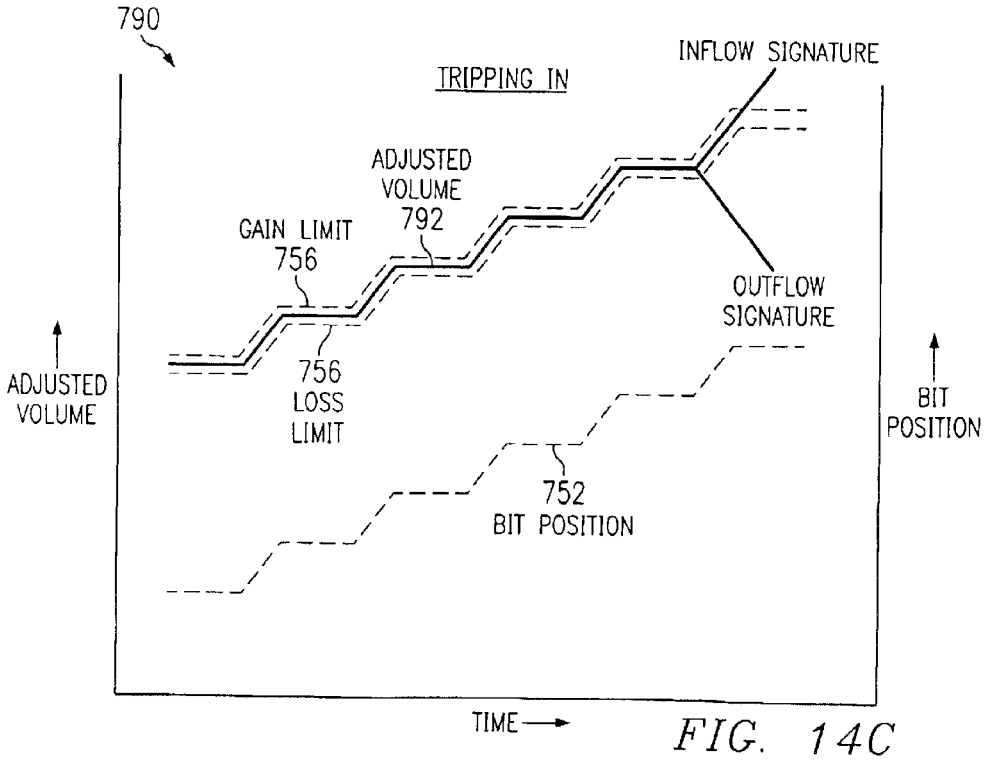

FIGS. 14A–C illustrate compensation for heave as part of event recognition during a tripping-in state of drilling operations, with the riser booster pumps operating, in accordance with several embodiments of the present invention. In FIGS. 14A–C, as described above in reference to FIG. 12, bit position 752 increases as the drilling string and down hole assembly are lowered into the well bore. In FIG. 14A, an intermediate heave compensation step is utilized between a mud tank volume limit being exceeded and an event alarm. In FIG. 14B, pre-determined variation limits are adjusted so as to compensate for heave. In FIG. 14C, mud tank volume calculations are adjusted so as to compensate for heave.

Referring to FIG. 14A, changes in volume 758 closely track the change in bit position within upper and lower limits 756; however, in the illustrated example, heave effects cause a periodic fluctuation of mud volume. As with the example shown in FIG. 12, actual inflow and outflow events may be recognized by a deviation of the volume from the gain and loss limits; however, heave effects also may cause deviations 760. In accordance with one method of compensation for the heave events, a deviation may be sensed and noted, and a determination made whether the deviation is caused by heave. The deviation may be disregarded if the deviation reflects the effects of heave rather than an inflow or outflow event.

Referring to FIG. 14B, an exemplary plot 770 illustrates an alternative method for compensating for heave. In the illustrated embodiment, the gain limits 772 have been adjusted so as to be outside the range of heave. In a particular embodiment, the adjustment may be accomplished by determining limits of variation due to sensor imprecision, mechanical and/or hydraulic noise, or other non-heave factors, determining the predicted effects of heave added to those limits, and then adding the non-heave variation to the heave variation.

Referring to FIG. 14C, reported mud tank volume may be adjusted for heave such that a plot of adjusted volume versus time is as shown in exemplary plot 790. The adjusted volume reflects mud tank volume calculations adjusted by taking into account heave, thus reflecting only those changes in mud volume not caused by heave. In this way, deviations of adjusted volume 792 from gain limits 756 reflect true inflow or outflow events and false alarms are avoided.

FIG. 15 is a flow diagram illustrating a method of well control event recognition during tripping-out-of the-hole operations in accordance with one embodiment of the present invention. The method illustrated in FIG. 15 may be used as an alternative to the method described in reference to steps 336–352 of FIG. 7. In particular, the method illustrated in FIG. 15 distinguishes between two modes of determining well control event recognition. In periodic fill mode, the hole is filled with mud from the pits after a specified number of stands has been removed from the hole.

Periodic fill mode typically comprises a period before the triptank mud pumps are operating. Continuous fill mode comprises operation of the triptanks, such that mud from the triptanks is continuously pumped into the annulus, filling the hole, and circulated back to the triptanks.

Referring to FIG. 15, the method begins with step 1000 wherein data is received. The data may comprise drilling state information from the drilling state detector 84, bit position data, rig pump strokes per minute, triptank volume data, and information concerning the number of stands removed from the hole.

At step 1002, it is determined whether tripping out operations are occurring. Tripping out operations may comprise a tripping-out-of-hole drilling state as determined by drilling state detector 84. In addition, tripping out operations for purposes of FIG. 15 may include intermediate "in slips" states determined by drilling state detector 84 when drill pipe stands are removed during tripping operations. If tripping out operations are not occurring, event recognition may not be accomplished with the method of FIG. 15, and the No branch of step 1002 leads to step 1026, wherein the method directs the system to another event recognition method, such as those shown FIG. 7.

If tripping out operations are occurring, the Yes branch of step 1002 leads to step 1003, wherein the well control module determines from bit position data whether the bit is at the top or bottom portions of the hole. Even if the drilling state detector 84 reports that the drilling state is consistent with tripping operations, the method of FIG. 15 may not be useful for event recognition for tripping operations wherein the bit position movement is limited to the very top-most and bottom-most portions of the hole. In a particular embodiment, the portions of the hole within 500' of the top of the hole or 100' of the bottom of the hole may be excluded from event recognition by the method of FIG. 15. Therefore, when tripping operations may be occurring, but the bit position is limited to the top 500' or bottom 100' portions of the hole, the method may follow the Yes branch of step 1003 and be directed to step 1026 and an alternative method of well control event recognition. In a particular embodiment, when the drill bit is below 500' from the surface and higher than 100' off the bottom, well control event recognition may be accomplished by determining whether mud flow into or out of the hole equals, or substantially equals, that calculated to occur as a result of the drill-pipe displacement. "Substantially equals" may mean the calculated and actual amounts are within normal sensing inaccuracies, noise, or other normal irregularities. In a particular embodiment in this context, "substantially equals" may mean within ten percent of the calculated value.

If tripping operations are not limited to the top 500' or bottom 100' of the hole, the Yes branch of step 1003 leads to decisional step 1004. At decisional step 1004, the trip mode is determined. As described above, periodic fill mode typically occurs before the triptank mud pumps are operating, and comprises the operator filling the hole with mud from the pits after a specified number of stands has been removed from the hole. Typically, the stands are about 100' in length and the hole is filled after five stands are removed. Continuous fill mode comprises tripping out of the hole with the triptank mud pumps continuously pumping mud into the annulus and circulating the mud back to the triptanks, such that the hole ideally is kept full continuously or substantially continuously.

The periodic fill mode branch of step 1004 leads to step 1006, wherein the adequacy of the hole filling is determined. In a particular embodiment, the change in bit position since the last known full hole is compared to the length of stands removed from the hole. The length of stands removed from the hole may comprise the number of stands removed from the hole (for example, five) multiplied by the length of an individual stand (typically 100'). If the change in bit position since the last known full hole is greater than the calculated length of stands removed from the hole, the method determines that the hole fill is inadequate. Inadequate hole fill may result in an inadequate downhole hydrostatic pressure, resulting in a potentially dangerous or otherwise undesirable condition. Therefore, the No branch of step 1006 leads to step 1024 wherein an inadequate hole fill flag is displayed, and the method returns to data receipt step 1000.

If hole fill from the rig pumps is determined to be adequate, then the Yes branch of step 1006 leads to step 1008. At step 1008, the total number of mud pump strokes needed to fill a length of the hole equivalent to one stand is calculated for the most recent hole filling. This calculation may be accomplished by summing the number of pump strokes needed to fill the hole after a specified number of stands has been removed from the hole. The equation for pump strokes per stand then becomes:

$$\text{Strokes per stand}=(\text{CumStrokes}\times(S))/\text{dBPOS}$$

where CumStrokes is the number of strokes for the time period between the start of the pumps and a full hole, S is the stand length (100'), and dBPOS is the change in bit position for the time period between the start of the pumps and a full hole.

Proceeding to decisional step 1010, it is determined whether the strokes per stand is consistent with previous values. If the strokes per stand is consistent or substantially consistent with values from previous hole fillings, then the Yes branch of step 1010 returns to data receipt step 1000. "Substantially consistent strokes per stand" in this context may mean variation and hole fill strokes are equivalent to less than about 0.3 bbl/100 ft. If the strokes per stand is not substantially consistent with previous values, then a possible well control event is indicated and the No branch of step 1010 leads to step 1012.

For the first set of removed stands (i.e., the first hole filling), there may be no previous strokes per stand values for comparison purposes. Thus, during the first hole filling event, at step 1010 the expected mud displacement from the removed drillpipe length may be compared to the volume of mud needed for the first hole filling event. If the expected and actual values are substantially consistent, then the No branch leads to data receipt step 1000. If the expected and actual values are not substantially consistent, then a possible well control event is indicated and the No branch leads to step 1012.

At decisional step 1012, the possible well control event is confirmed by determining if there is a substantial change in mud pit volume. A "substantial change" may in this context may mean a change that is above normal operational changes, a change that is outside normal sensing or other irregularities and/or change at a level that indicates an event needs to be monitored and/or interrupted. In a particular embodiment, a "substantial change in mud pit volume" change equal to or greater than a predetermined amount, such as five barrels.

If there is not a substantial change in mud pit volume, the No branch of step 1012 leads to step 1016 and a "yellow" warning flag is displayed. The yellow warning flag may warn the operator that there is some indication of a well control event, such that caution is warranted, but that the event is not yet confirmed. If there is a substantial change in mud pit volume, the Yes branch of step 1012 leads to step 1014 and a "red" warning flag is displayed. A red warning flag indicates a confirmed well control event representing an imminent danger to the rig and/or crew, and that the operator should immediately take an appropriate course of action. After each of steps 1014 and 1016, the method returns to data receipt step 1000.

Returning to decisional step 1004, the continuous fill mode branch of step 1004 leads to step 1018, wherein the adequacy of the hole filling from the triptank pumps is determined. In a particular embodiment, an inadequate hole fill pump rate is indicated when there is not flow-back measured between two consecutive out-of-slip detections. If hole fill is inadequate, and the method proceeds to step 1024, as above, wherein an inadequate hole-fill flag is displayed, and the method returns to data receipt step 1000.

If hole fill from the triptank pumps is determined to be adequate, then the Yes branch of step 1018 leads to step 1020. At step 1020, the change in triptank volume for each stand removed is calculated. In one embodiment, the change in triptank volume per stand is:

$$\text{Volume per stand}=(\text{dTTank}\times(S))/\text{dBPOS}$$

where dTTank is the change in triptank volume between two out-of-slips states, S is the stand length (100'), and dBPOS is the change in bit position between two out-of-slips states.

Proceeding to decisional step 1022, it is determined whether the observed volume per stand calculated during step 1020 differs from the expected displacement based upon the number of stands removed and the volumetric parameters of each cylindrical stand. If the volume per stand does not differ from expected values for a specified number of stands removed (for example, five stands), then the Yes branch of step 1022 returns to data receipt step 1000. If the volume per stand does differ with expected values for the specified number of stands, then a possible well control event is indicated and the No branch of step 1022 leads to step 1012. In addition or in the alternative, it may be determined at step 1022 whether the volume per stand consistently differs from expected values for each stand removed. "Substantially differs" may mean differs above normal operational differences, differs in an amount outside normal sensing or other irregularities and/or differs at a level that indicates an event needs to be monitored and/or interrupted. In a particular embodiment, "consistently differs" may mean a variation in measured trip tank loss of more than about 0.3 bbl per 100' of pipe displacement, such loss being checked for each stand.

The yes branch of step 1022 leads to step 1012. As described above, at step 1012 the possible well control event is confirmed by observing changes pit volume, as described above. In a particular embodiment, five consecutive stands wherein the measured trip tank loss varies more than 0.3 bbl per 100' from pipe displacement would be indicative of a red flag condition.

Although the present invention has been described with reference to drilling rig 10, the corresponding states of drilling operations and event recognition for drilling states, the invention may be used to determine one or more states and/or events associated with other suitable petroleum and geosystem operations for a well. Such well operations may include work-over procedures, well completions, natural-gas operations, well testing, cementing, well abandonment, well stimulation, acidizing, squeeze jobs, wire line applications and water/fluid treatment.

For example, mud fluid circulation systems generally include a series of stages that may be identified by using mechanical and hydraulic data as feedback from the associated system. Mud fluid circulation systems are generally used to maintain hydrostatic pressure for well control, carry drill cuttings to the surface, and cool and/or lubricate the drill bit during drilling. The mud or water used to make up the drilling fluid may require treatment to remove dissolved calcium and/or magnesium. Soda ash may be added to form a precipitate of calcium carbonate. Caustic soda (NaOH) may also be added to form magnesium hydroxide. Accordingly, fluid characteristics (such as pressure and fluid-flow rate) and chemical-based parameters may be suitably monitored in accordance with the teachings of the present invention in order to determine one or more of the identified states or other states of the operations as well as events associated with the operation. Events may include out of balance fluid parameters.

In addition, production procedures and activities (such as fracs, acidizing, and other well-stimulating techniques) represent another example of petroleum operations within the scope of the present invention. Production operations may encompass any operations involved in bringing well fluids (or natural gas) to the surface and may further include preparing the fluids for transport to a suitable refinery or a next processing destination, and well treatment procedures used generally to optimize production. The first step in production is to start the well fluids flowing to the surface (generally referred to as "well completion"). Well servicing and workover consists of performing routine maintenance operations (such replacing worn or malfunctioning equipment) and performing more extensive repairs, respectively. Well servicing and workover are an intermittent step and generally a prerequisite in order to maintain the flow of oil or gas. Fluid may be then separated into its components of oil, gas, and water and then stored and treated (for purification), suitably measured, and properly tested where appropriate before being transported to a refinery. Well workovers may additionally involve recompletion in a different pay zone by deepening the well or by plugging back. In accordance with the teachings of the present invention, each of these procedures may be monitored such that feedback is provided in order to determine one or more of the identified states or other states of the corresponding operation and to recognize events of the operation. Events may, for example, be any out of limit parameter or hazardous condition.

Additionally, well or waste treatments represent yet another example of petroleum operations that include various stages that may be identified with use of the present invention. Well or waste treatments generally involve the use of elements such as: paraffin, slop oil, oil and produced water-contaminated soils. In well or waste treatments, purification and refinement stages could provide suitable feedback in offering mechanical data for selecting a corresponding state. Such states may include, for example, collecting, pre-treatment, treatment, settling, neutralization and out pumping. Events may include accidental release of contaminates.

Thus the monitoring and recognition system of the present invention may be used in connection with any suitable system, architecture, operation, process or activity associated with petroleum or geosystem operations of a well capable of providing an element of feedback data such that a stage associated with the operation may be detected, diagnosed, or identified is within the scope of the present invention. In these operations, the drilling rig 10 may not be on location. In these embodiments, such as in connection with frac jobs and stimulation, sensor data may be retrieved via wireline and/or mud pulses from down hole equipment and/or directly from surface equipment and systems.

In non-drilling applications, any suitable reference point may be tracked. For example, for pumping operations, pure volumetric data may be tracked and used to determine the state of operations. In all of these embodiments, the monitoring system may include a sensing system for sensing, refining, manipulating and/or processing data and reporting the data to a monitoring module. The sensed data may be validated and parameters calculated as previously described in connection with monitoring module 80. The resulting state indicators may be fed to a state determination module to determine the current state of the operation. The state is the overall conclusion regarding the status at a given point and time based on key measurable elements of the operation. For example, for frac operations, the states may include high and low pressure states, fluid and slurry pumping states, proppant states, and backwash/cleansing states. For acid jobs, the states may include flow and pressure states, pumping states, pH states, and time-based states. Well completion operations may include testing, pumping, cementing and perforating states. For each of these and other well operations, the sensing system may include fluid systems, operator systems, pumping systems, down hole systems, surface systems, chemical analysis systems, and other systems operable to measure and provide data on the well operation.

As previously described, the state determinator module may store a plurality of possible and/or predefined states for the operation. In this embodiment, the state of operations may be selected from the defined set of states based on the state indicators. Events for the operation may be recognized and flagged as previously described. Events may include high or low pressure, loss of circulation, system or device failure, conditions hazardous to persons or property, and the like.

Although the present invention has been described with several embodiments, various changes and modifications may be suggested to one skilled in the art. It is intended that the present invention encompass such changes and modifications as fall within the scope of the appended claims.

What is claimed is:

1. An automated method for recognizing a well control event, comprising:

determining a state of drilling operations; and when drilling operations are in a circulating state:

determining a benchmark for a relative flow value, the relative flow value based on a flow of drilling fluid into a well bore and a flow of drilling fluid out of the well bore;

determining a limit on variation of the relative flow value from the benchmark;

determining a cumulative sum for the relative flow value over time in response to at least the relative flow value exceeding the limit; and recognizing a well control event based on the cumulative sum.

2. The method of claim 1, wherein the relative flow value is based on a ratio of the flow of drilling fluid out of the well bore and the flow of drilling fluid into the well bore.

3. The method of claim 1, further comprising:

determining whether drilling fluid flow conditions are stabilized; and determining the benchmark in response to at least stable flow conditions.

4. The method of claim 3, wherein the stable flow conditions are determined when variations in the relative flow value fall below a selected threshold.

5. The method of claim 1, further comprising determining the flow of drilling fluid into the well bore based on a flow of drilling fluid pumped from a mud tank.

6. The method of claim 1, further comprising determining the flow of drilling fluid from the well bore based on a flow of drilling fluid into at least one mud tank.

7. The method of claim 1, further comprising determining the limit on variation based on variation of the relative flow value during stable flow conditions.

8. The method of claim 1, where the cumulative sum is based on cumulative deviations from the benchmark of the relative flow value.

9. The method of claim 1, wherein the well control event comprises a well inflow event, further comprising generating an alarm in response to at least the well inflow event.

10. The method of claim 1, wherein the well control event comprises a well outflow event, further comprising generating an alarm in response to at least the well outflow event.

11. The method of claim 1, further comprising recognizing the well control event based on the cumulative sum exceeding a volume-based limit.

12. The method of claim 11, wherein the volume-based limit is dynamically calculated based on real-time operational parameters.

13. The method of claim 12, wherein the real-time operational parameters comprise at least one of stand pipe pressure, weight on bit, strokes per minute of a mud pump, the cumulative sum, and the mud tank level.

14. The method of claim 1, further comprising recognizing the well control event based on a deviation of the cumulative sum over a period of time.

15. The method of claim 1, further comprising:

when drilling operations are in the circulating state, further repetitively determining the relative flow value in real-time and comparing the relative flow value to the limit on variation.

16. The method of claim 15, further comprising:

when drilling operations are in a non-circulating, constant bit position state, repetitively determining whether there is substantial flow from the well bore.

17. The method of claim 15, further comprising, when drilling operations are in a non-circulating, non-constant bit position state, repetitively determining whether the displacement of drilling fluid in at least one of the well bore and a mud tank is within a limit of displacement caused by the movement of a drill string used for the drilling operations.

18. The method of claim 1, further comprising, in determining the benchmark for the relative flow, compensating for movement of the drilling platform.

19. The method of claim 1, wherein the limit on variation comprises a selected number of standard deviations of the relative flow value from the benchmark.

20. The method of claim 1, further comprising resetting the cumulative sum to zero when the relative flow value falls below the limit on variation for a predetermined time interval.

21. An automated system for recognizing a well control event, comprising:

means for determining a state of drilling operations; and when drilling operations are in the circulating state:

determining a benchmark for a relative flow value, the relative flow value based on a flow of drilling fluid into a well bore and a flow of drilling fluid out of the well bore;

determining a limit on variation of the relative flow value from the benchmark;

determining a cumulative sum for the relative flow value over time in response to the relative flow value exceeding the limit; and recognizing a well control event based on the cumulative sum.

22. The system of claim 21, wherein the relative flow value is based on a ratio of the flow of drilling fluid out of the well bore and the flow of drilling fluid into the well bore.

23. The system of claim 21, further comprising:

means for determining whether drilling fluid flow conditions are stabilized; and means for determining the benchmark in response to at least stable flow conditions.

24. The system of claim 23, wherein the stable flow conditions are determined when variations in the relative flow value fall below a selected threshold.

25. The system of claim 21, further comprising means for determining the flow of drilling fluid into the well bore based on a flow of drilling fluid pumped from a mud tank.

26. The system of claim 21, further comprising means for determining the flow of drilling fluid from the well bore based on a flow of drilling fluid into at least one mud tank.

27. The system of claim 24, further comprising means for determining the limit on variation based on variation of the relative flow value during stable flow conditions.

28. The system of claim 24, wherein the cumulative sum is based on cumulative deviations from the benchmark of the relative flow value.

29. The system of claim 24, further comprising means for recognizing the well control event based on the cumulative sum exceeding a volume-based limit.

30. The system of claim 31, further comprising means for dynamically calculating the volume-based limit based on real-time operational parameters.

31. The system of claim 32, wherein the real-time operational parameters comprise at least one of stand pipe pressure, weight on bit, strokes per minute of a mud pump, and the cumulative sum.

32. The system of claim 24, further comprising means for recognizing the well control event based on a continued deviation of the cumulative sum over a period of time.

33. The system of claim 24, further comprising:

means for, when drilling operations are in the circulating state, further repetitively determining the relative flow value in real-time and comparing the relative flow value to the limit on variation.

34. The system of claim 35, further comprising means for, when drilling operations are in a non-circulating, constant bit position state, repetitively determining whether there is substantial inflow.

35. The system of claim 33, further comprising, means for, when drilling operations are in a non-circulating, non-constant bit position state, repetitively determining whether the displacement of drilling fluid in at least one of the well bore and a mud tank is within a limit of displacement caused by the movement of a drill string.

36. The system of claim 21, further comprising means for, in determining the benchmark for the relative flow value, compensating for movement of the drilling platform.

37. The system of claim 21, wherein the limit on variation comprises a selected number of standard deviations of the relative flow value from the benchmark.

38. The system of claim 21, further comprising means for resetting the cumulative sum to zero when the relative flow value falls below the limit on variation for a predetermined time interval.

39. An automated system for recognizing a well control event, comprising:

logic encoded in media; and logic operable to:

determine a state of drilling operations; and when drilling operations are in a circulating state:

determine a benchmark for a relative flow value, the relative flow value based on a flow of drilling fluid into a well bore and a flow of drilling fluid out of the well bore;

determine a limit on variation of the relative flow value from the benchmark;

determine a cumulative sum for the relative flow value over time in response to the relative flow value exceeding the limit; and recognize a well control event based on the cumulative sum.

40. The system of claim 39, wherein the relative flow value is based on a ratio of the flow of drilling fluid out of the well bore and the flow of drilling fluid into the well bore.

41. The system of claim 39, the logic further operable to:

determine whether drilling fluid flow conditions are stabilized; and determine the benchmark in response to at least stable flow conditions.

42. The system of claim 41, wherein flow conditions are stabilized when variations in the relative flow value fall below a selected threshold.

43. The system of claim 39, the logic further operable to determine the flow of drilling fluid into the well bore based on a flow of drilling fluid pumped from a mud tank.

44. The system of claim 39, the logic further operable to determine the flow of drilling fluid from the well bore based on a flow of drilling fluid into at least one mud tank.

45. The system of claim 39, the logic operable to determine the limit a variation based on variation of the relative flow value during stable flow conditions.

46. The system of claim 39, the logic operable to determine the cumulative sum based on cumulative deviations from the benchmark of the relative flow value.

47. The system of claim 39, the logic operable to recognize the well control event based on the cumulative sum exceeding a volume-based limit.

48. The system of claim 47, wherein the volume-based limit is dynamically calculated based on real-time operational parameters.

49. The system of claim 48, wherein the real-time operational parameters comprise at least one of stand pipe pressure, weight on bit, strokes per minute of a mud pump, and the cumulative sum.

50. The system of claim 39, the logic further operable to recognize the well control event based on a continued deviation of the cumulative sum over a period of time.

51. The system of claim 39, the logic further operable to, when the drilling operations are in a circulating state, adjust the relative flow value to account for changes in a total circulating volume of the well bore and a drilling fluid circulating system.

52. The system of claim 39, wherein the limit on variation comprises a selected number of standard deviations of the relative flow value from the benchmark.

53. The system of claim 39, the logic operable to recognize the well control event when the cumulative sum exceeds a first selected threshold.

54. The system of claim 53, wherein the first selected threshold comprises a selected fluid volume.

55. The system of claim 54, the logic further operable to generate first alarm when the cumulative sum exceeds the first selected threshold.

56. The system of claim 53, the logic further operable to determine a value of a warning indicator when the cumulative sum exceeds the first selected threshold.

57. The system of claim 56, wherein the value of the warning indicator comprises a preselected second threshold for the cumulative sum, the second threshold larger than the first selected threshold.

58. The system of claim 57, the logic further operable to recalculate the second selected threshold based on at least one real-time drilling parameter.

59. The system of claim 58, wherein the at least one real-time drilling parameter comprises at least one of stand pipe pressure, weight on bit, strokes per minute of a mud pump, the cumulative sum, and the mud tank level.

60. The system of claim 57, the logic further operable to generate a second alarm when the cumulative sum exceeds the second threshold.

61. The system of claim 39, the logic further operable to reset the cumulative sum to zero when the relative flow falls below the variation limit for a predetermined time interval.

62. The system of claim 39, the logic operable to, when drilling operations are in the circulating state, repetitively determine the relative flow value in real-time and to compare the relative flow value to the limits on variation.

63. The system of claim 62, the logic operable to, when drilling operations are in a non-circulating, constant bit position state, determine whether there is substantial flow from the wellbore.

64. The system of claim 62, the logic operable to, when drilling operations are in a non-circulating, non-constant bit position state, repetitively determine whether the displacement of drilling fluid in at least one of the well bore and a mud tank is within a limit of displacement caused by the movement of a drill string used for the drilling operation.

65. The system of claim 39, further comprising, in determining the benchmark for the relative flow value, compensating for movement of the drilling platform.

66. The system of claim 39, the logic further operable to reset the cumulative sum to zero when the relative flow value falls below the limit on variation for a predetermined time interval.

* * * * *